US007641057B2

(12) United States Patent
Mueller et al.

(10) Patent No.: US 7,641,057 B2
(45) Date of Patent: Jan. 5, 2010

(54) ADJUSTABLE SHELVING SYSTEM

(75) Inventors: Paul A. Mueller, Wadsworth, OH (US); Daniel J. Kump, Highland Hts., OH (US)

(73) Assignee: Fasteners For Retail, Inc., Cleveland, OH (US)

( * ) Notice: Subject to any disclaimer, the term of this patent is extended or adjusted under 35 U.S.C. 154(b) by 90 days.

(21) Appl. No.: 10/854,991

(22) Filed: May 27, 2004

(65) Prior Publication Data

US 2005/0092703 A1 May 5, 2005

Related U.S. Application Data

(63) Continuation-in-part of application No. 10/686,096, filed on Oct. 14, 2003.

(51) Int. Cl.
*A47F 7/00* (2006.01)

(52) U.S. Cl. ..... 211/59.3; 211/51; 211/59.4; 206/817; 206/221

(58) Field of Classification Search ..... 211/59.351, 211/134, 186; 312/71; 206/817; 221/271, 221/279

See application file for complete search history.

(56) References Cited

U.S. PATENT DOCUMENTS

| | | | |
|---|---|---|---|
| 1,971,749 | A | 8/1934 | Hamilton |
| 2,079,754 | A | 5/1937 | Waxgiser |
| 2,652,154 | A | 9/1953 | Stevens |
| 2,678,045 | A | 5/1954 | Erhard |
| 3,038,067 | A | 6/1962 | Dench et al. |
| 3,161,295 | A | 12/1964 | Chesley |
| 3,308,961 | A | 3/1967 | Chesley |
| 3,452,899 | A | 7/1969 | Libberton |
| 3,751,129 | A | 8/1973 | Wright et al. |
| 3,814,490 | A | 6/1974 | Dean et al. |
| 3,868,021 | A | 2/1975 | Heinrich |
| 4,042,096 | A | 8/1977 | Smith |
| 4,106,668 | A | 8/1978 | Gebhardt et al. |
| 4,269,326 | A | 5/1981 | Delbrouck |
| 4,303,162 | A | 12/1981 | Suttles |
| 4,351,439 | A | 9/1982 | Taylor |

(Continued)

FOREIGN PATENT DOCUMENTS

| | | |
|---|---|---|
| CH | 412251 | 4/1966 |

(Continued)

OTHER PUBLICATIONS

FFr Yellow Pages® 2003 Product Catalog, "Merchandising Ideas Made Easy For Every Retail Environment!", Cover p. 9-11, 48-49, 52-58, Back Cover.

*Primary Examiner*—Kambiz Abdi
*Assistant Examiner*—Lindsay M. Maguire
(74) *Attorney, Agent, or Firm*—Fay Sharpe LLP

(57) ABSTRACT

A shelving system includes an elongated mounting member operationally securable to an associated shelf. The mounting member includes an approximately vertically oriented wall, and an approximately horizontally oriented wall. A track is received on said mounting member in a sliding manner. The track extends approximately transversely to a longitudinal axis of the associated shelf. The track includes an elongated rail extending longitudinally along the track, and a pusher slidably mounted in relation to the rail. A divider is received on the mounting member in a non-sliding manner, wherein the divider extends approximately transversely to the longitudinal axis of the associated shelf. The divider is spaced from the track.

33 Claims, 27 Drawing Sheets

U.S. PATENT DOCUMENTS

| | | | | |
|---|---|---|---|---|
| 4,378,872 | A | 4/1983 | Brown | |
| 4,488,653 | A | 12/1984 | Belokin | |
| 4,615,276 | A | 10/1986 | Garabedian | |
| 4,724,968 | A | 2/1988 | Wombacher | |
| 4,730,741 | A | 3/1988 | Jackle, III et al. | |
| 4,762,236 | A | 8/1988 | Jackle, III et al. | |
| 4,775,058 | A | 10/1988 | Yatsko | |
| 4,830,201 | A | 5/1989 | Breslow | |
| 4,907,707 | A | 3/1990 | Crum | |
| 5,110,192 | A | 5/1992 | Lauterbach | |
| 5,111,942 | A | 5/1992 | Bernardin | |
| 5,161,704 | A | 11/1992 | Valiulis | |
| 5,190,186 | A | 3/1993 | Yablans et al. | |
| 5,203,463 | A | 4/1993 | Gold | |
| 5,255,802 | A | 10/1993 | Krinke et al. | |
| 5,295,591 | A | 3/1994 | Slater | |
| 5,341,945 | A | 8/1994 | Gibson et al. | |
| 5,351,839 | A | 10/1994 | Beeler et al. | |
| 5,390,802 | A | 2/1995 | Pappagallo et al. | |
| 5,450,969 | A | 9/1995 | Johnson et al. | |
| 5,469,976 | A | 11/1995 | Burchell | |
| 5,562,217 | A * | 10/1996 | Salveson et al. | 211/59.3 |
| 5,593,048 | A | 1/1997 | Johnson | |
| 5,634,564 | A | 6/1997 | Spamer et al. | |
| 5,665,304 | A | 9/1997 | Heinen et al. | |
| 5,673,801 | A | 10/1997 | Markson | |
| 5,746,328 | A | 5/1998 | Beeler et al. | |
| 5,839,588 | A | 11/1998 | Hawkinson | |
| 6,041,720 | A | 3/2000 | Hardy | |
| 6,082,557 | A | 7/2000 | Leahy | |
| 6,129,218 | A | 10/2000 | Henry et al. | |
| 6,142,317 | A | 11/2000 | Merl | |
| 6,227,385 | B1 | 5/2001 | Nickerson | |
| 6,234,328 | B1 | 5/2001 | Mason | |
| D445,615 | S | 7/2001 | Burke | |
| 6,382,431 | B1 | 5/2002 | Burke | |
| 6,409,027 | B1 | 6/2002 | Chang et al. | |
| 6,409,028 | B2 | 6/2002 | Nickerson | |
| 6,464,089 | B1 | 10/2002 | Rankin, VI | |
| 6,484,891 | B2 | 11/2002 | Burke | |
| 6,527,127 | B2 | 3/2003 | Dumontet | |
| 6,533,131 | B2 | 3/2003 | Bada | |
| D472,411 | S | 4/2003 | Burke | |
| 6,622,874 | B1 | 9/2003 | Hawkinson | |
| 6,655,536 | B2 | 12/2003 | Jo et al. | |
| 6,666,533 | B1 | 12/2003 | Stavros | |
| D485,699 | S | 1/2004 | Mueller et al. | |
| 6,772,888 | B2 | 8/2004 | Burke | |
| 6,964,235 | B2 * | 11/2005 | Hardy | 108/61 |
| 2001/0002659 | A1 | 6/2001 | Bada | |
| 2001/0010302 | A1 | 8/2001 | Nickerson | |
| 2002/0108916 | A1 | 8/2002 | Nickerson | |
| 2002/0170866 | A1 | 11/2002 | Johnson et al. | |
| 2003/0057167 | A1 | 3/2003 | Johnson et al. | |
| 2003/0085187 | A1 | 5/2003 | Johnson et al. | |
| 2003/0141265 | A1 | 7/2003 | Jo et al. | |
| 2003/0217980 | A1 | 11/2003 | Johnson et al. | |

FOREIGN PATENT DOCUMENTS

| | | |
|---|---|---|
| DE | 28 25 724 | 12/1979 |
| EP | 270016 | 6/1988 |
| EP | 0 337 340 | 10/1989 |
| EP | 986980 | 3/2000 |
| FR | 2 526 338 | 5/1982 |
| FR | 2617385 | 1/1989 |
| FR | 2 724 098 | 3/1996 |
| GB | 2 027 339 | 2/1980 |
| GB | 2290077 | 12/1995 |
| JP | 59-218-113 | 12/1984 |
| WO | WO 01/17404 | 3/2001 |
| WO | WO 02/091885 | 11/2002 |

* cited by examiner

FIG. 17
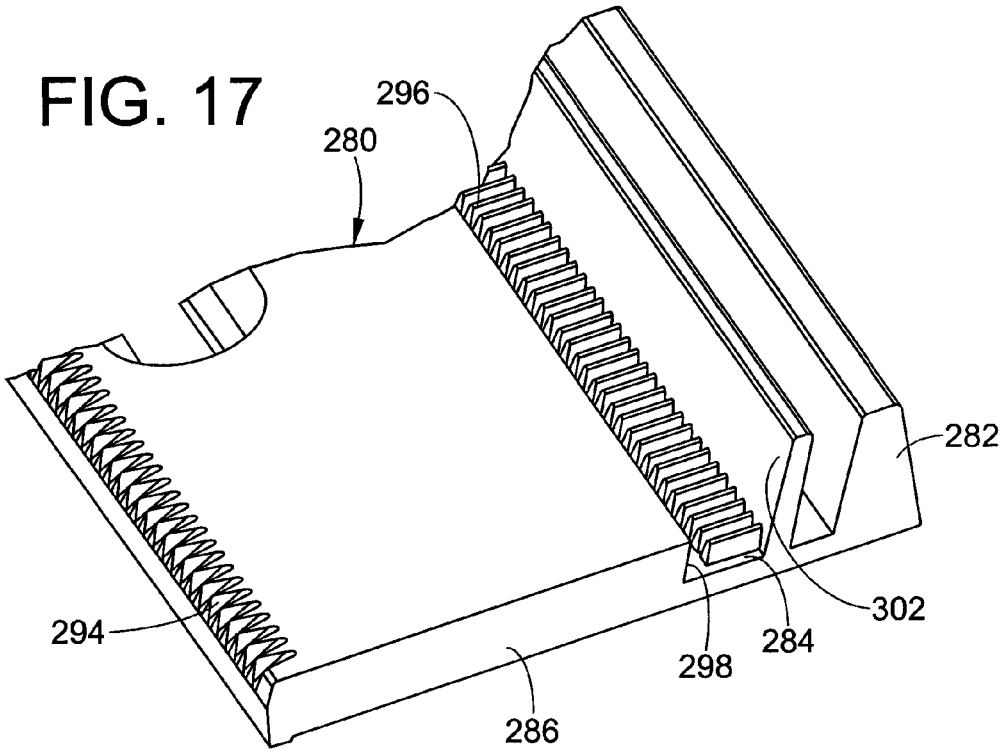
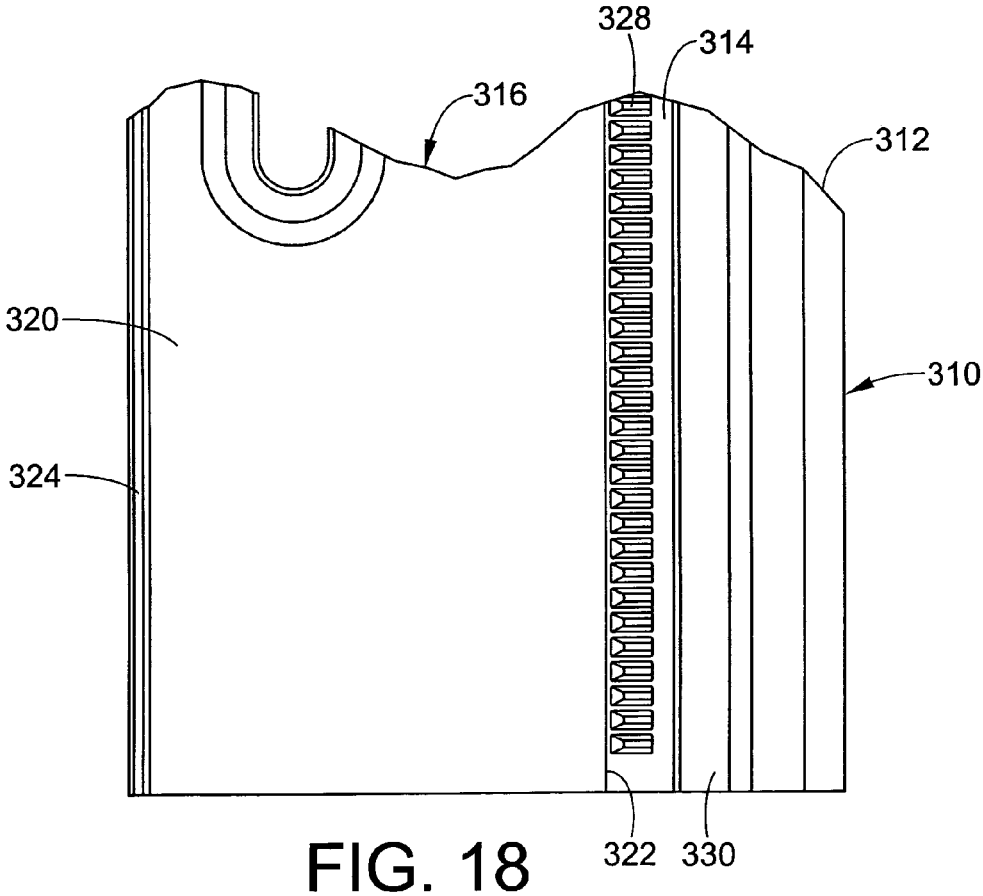
FIG. 18

ADJUSTABLE SHELVING SYSTEM

This application is a continuation-in-part application of Ser. No. 10/686,096 which was filed Oct. 14, 2003.

FIELD OF THE INVENTION

The present invention generally relates to adjustable shelving systems. More particularly, the present invention relates to adjustable forward feeding display shelving system for storing and displaying merchandise of a variety of shapes and sizes and urging such merchandise towards the front of a shelf. The shelving system is configured to organize merchandise on the shelf into rows.

BACKGROUND OF THE INVENTION

Shelving is used extensively for stocking and storing products or merchandise in a variety of stores. Most stores simply employ shelves on which merchandise is stocked. In such stores if the shelves are not at eye level, it is difficult for the customer to see the items being displayed unless they are located adjacent the front edge of the shelf. Such conventional shelves also make it difficult to rotate the product on the shelves, which involves moving the older stock to the front of the shelf and positioning new stock behind the older stock. This has to be done manually by an employee. Thus, for a number of important merchandising considerations, it is desirable that the merchandise be displayed at the front of a shelf so that the customer can see the merchandise and be induced to purchase such merchandise. For example, if goods are perishable or are subject to becoming stale (e.g. cigarettes, fruit juices, dairy products or any item with an expiration date or a freshness date) it is important that the articles be removed in a first in first out basis to maintain freshness. As mentioned, if the merchandise is not displayed at the front of the shelf, it may not catch the shopper's eye, which may cost the merchant sales.

In order to automatically move an item forward as the one before it is removed, numerous forward feed devices have been proposed. These devices generally fall into three categories. The first category is inclined tracks, which rely on gravity to feed, slide or roll products forward. Gravity feeding is somewhat unpredictable in that various materials slide easier than others because of different weights and frictional interfaces between the products and the track. A second category employs conveyor belts, which still use gravity to effect forward movement. These devices are typically cumbersome, expensive and complicated due to the need to properly tension and track the conveyor belts. A third category uses spring biased paddles in a pusher system to feed the product forward. Such pusher systems have been found useful for certain merchandise.

Forward feed devices are usually associated with divider walls. Normally, a divider wall is located on either side of, for example, a pusher system. Both the pusher system and the divider wall are mounted to at least a front rail or front mounting member in order to allow a spacing of the pusher systems and divider walls on a shelf. In some known systems, the divider walls are separate from the pusher systems. In others, the divider walls and pusher systems are of one piece. In either case, the divider walls and pusher systems can be slidably mounted on the front rail or mounting member. This, however, has some disadvantages. Such disadvantages have to do with the fact that as the merchandise is being urged forward by the pusher, the merchandise may urge the dividers to slide laterally away from each other along the mounting member thus interfering with adjacent rows of merchandise, possibly making such merchandise more difficult to retrieve. This is particularly true with cans and other merchandise having rounded sides, since with such merchandise one item can rotate in relation to another as it is being pushed forward.

Certain merchandising systems employ a design in which the divider wall and the pusher are locked to a front rail or mounting member so as to prevent a sideward sliding thereof. However, with these known designs, the dividers and the pusher systems have to be physically removed from contact with the front rail in order to provide lateral adjustability thereto. The known systems also have other disadvantages.

Accordingly, it has been considered desirable to develop a new improved shelf divider system which would overcome the foregoing difficulties and others while providing better and more advantageous overall results.

SUMMARY OF THE INVENTION

According to one aspect of the present invention, a shelving system comprises an elongated mounting member selectively securable to a front portion of an associated shelf. The mounting member comprises an approximately horizontally oriented wall. A raised area is located on the horizontally oriented wall. The raised area includes a front face which is oriented at an acute angle relative to a horizontal plane. A track is received on the mounting member in a sliding manner, wherein the track extends rearwardly over the associated shelf. A flange protrudes from and extends transversely along a bottom face of said track, wherein said flange frictionally engages the front face to retard sideward sliding motion of the track in relation to the mounting member.

According to a further aspect of the present invention, a shelving system comprises an elongated mounting member operationally securable to an associated shelf, the mounting member comprising an approximately vertically oriented wall and an approximately horizontally oriented wall. A track is received on the mounting member in a sliding manner, wherein the track extends approximately transversely to a longitudinal axis of the associated shelf. The track comprises an elongated rail extending longitudinally along the track and a pusher slidably mounted in relation to the rail. A divider is received on the mounting member in a non-sliding manner, wherein the divider extends approximately transversely to the longitudinal axis of the associated shelf. The divider is spaced from the track.

According to yet another aspect of the present invention, a shelving system comprises an elongated mounting member operationally securable to a front portion of an associated shelf, the mounting member comprising an approximately vertically oriented wall and an approximately horizontally oriented wall. A track is received on the mounting member in a sliding manner, wherein the track extends rearwardly over the associated shelf. An elongated rail extends longitudinally along the track. A spring urged pusher is slidably mounted in relation to the rail. A divider is received on the mounting member in a non-sliding manner, wherein the divider extends rearwardly over the associated shelf. The divider is spaced from the track. A slot extends transversely along the bottom face of the divider. A first set of teeth extend at least partially from a face of the mounting member and a second set of teeth extend from the divider adjacent the slot. The second set of teeth engage the first set of teeth to retard a sideward sliding motion of the divider in relation to the mounting member.

According to a yet further aspect of the present invention, a merchandising system comprises an elongated mounting member operationally securable to the front portion of an associated shelf and extending along a longitudinal axis thereof. The mounting member comprises an approximately vertically oriented wall, an approximately horizontally oriented wall, and a first set of teeth extending at least partially from a face of said mounting member approximately horizontally oriented wall. A plurality of spaced tracks are received on the mounting member in a sliding manner wherein the tracks extend rearwardly over the associated shelf, each of the tracks including a pusher slidably mounted thereon. A plurality of spaced dividers are received on the mounting member in a non-sliding manner, each of the dividers including a second set of teeth extending from the divider. The second set of teeth engage the first set of teeth to retard a sideward sliding motion of each divider in relation to the mounting member.

Still other aspects of the present invention will become apparent to those of average skill in the art upon a reading and understanding of the following detailed specification.

DETAILED DESCRIPTION OF THE DRAWINGS

The present invention may take physical form in certain parts and arrangements of parts, several embodiments of which will be described in detail in this specification and illustrated in the accompanying drawings, which form a part hereof and wherein:

FIG. 17 is a perspective view of a rail or mounting member according to a fourth embodiment of the present invention;

FIG. 18 is a top plan view of a mounting member according to a fifth embodiment of the present invention;

DETAILED DESCRIPTION OF THE PREFERRED EMBODIMENTS

Figure 1:
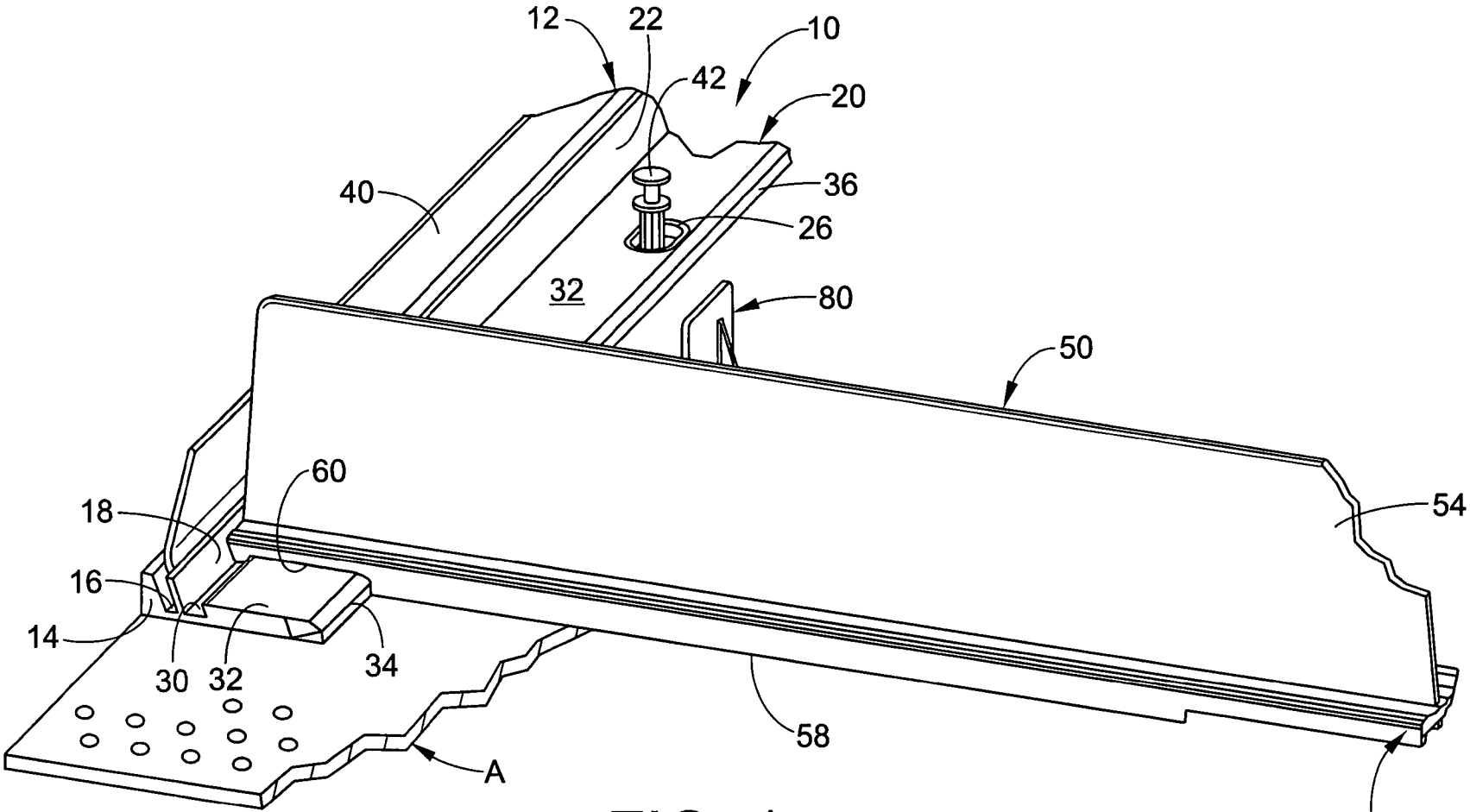
FIG. 1 is a perspective view of a shelving system including a shelf divider mounted on a front rail or mounting member in a non-slidable manner according to a first embodiment of the present invention.
Figure 2:
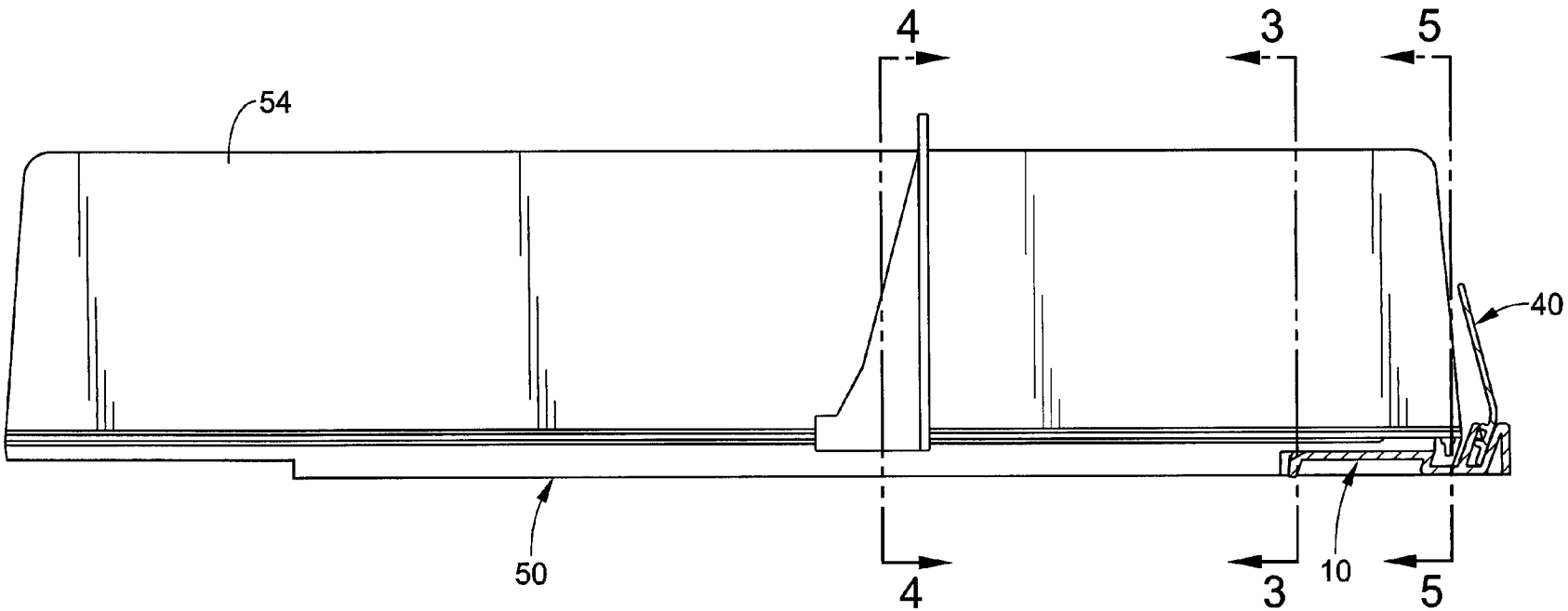
FIG. 2 is a reverse side elevational view of the system of FIG. 1.
Figure 7:
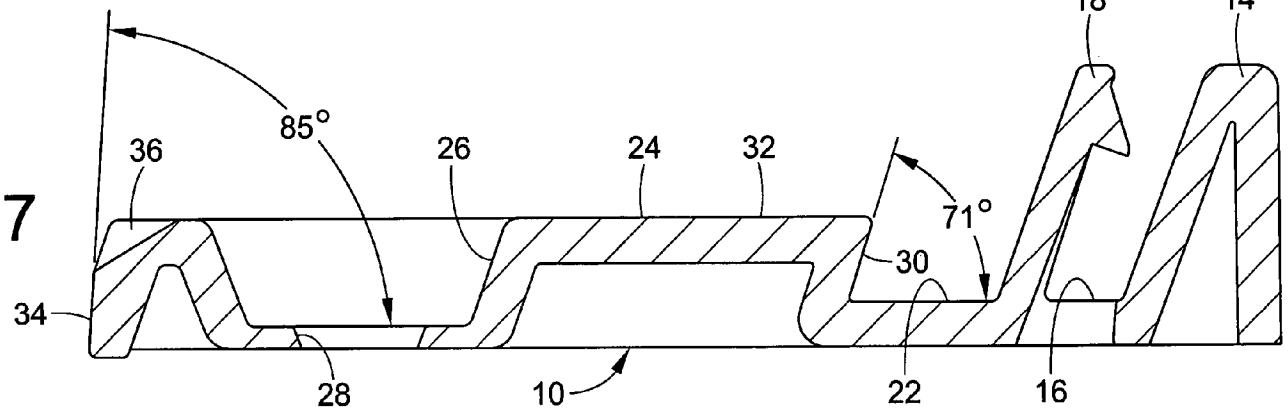
FIG. 7 is a greatly enlarged reverse cross-sectional view of the front rail or mounting member of FIG. 1.

Referring now to the drawings, wherein the showings are for purposes of illustrating several preferred embodiments of the invention and not for purposes of limiting the same, FIG. 1 illustrates a first embodiment of a shelf divider system according to the present invention. In this embodiment, a mounting member or front rail 10 includes a vertically oriented wall 12. With reference also to FIG. 7, the vertically oriented wall 12 includes a first section 14, a first groove 16 and a second section 18. Also provided on the mounting member 10 is a horizontally oriented wall 20. Disposed between the horizontally oriented wall section and the vertical wall section 12 is a second groove 22. There is a recessed portion 26 with an opening 28 located in the horizontal wall 20. The wall 20 includes a front face 30, a top face 32 and a back face 34. Defined at the intersection of the top face 32 and the back face 34 is a first row or set of teeth 36.

Figure 8:
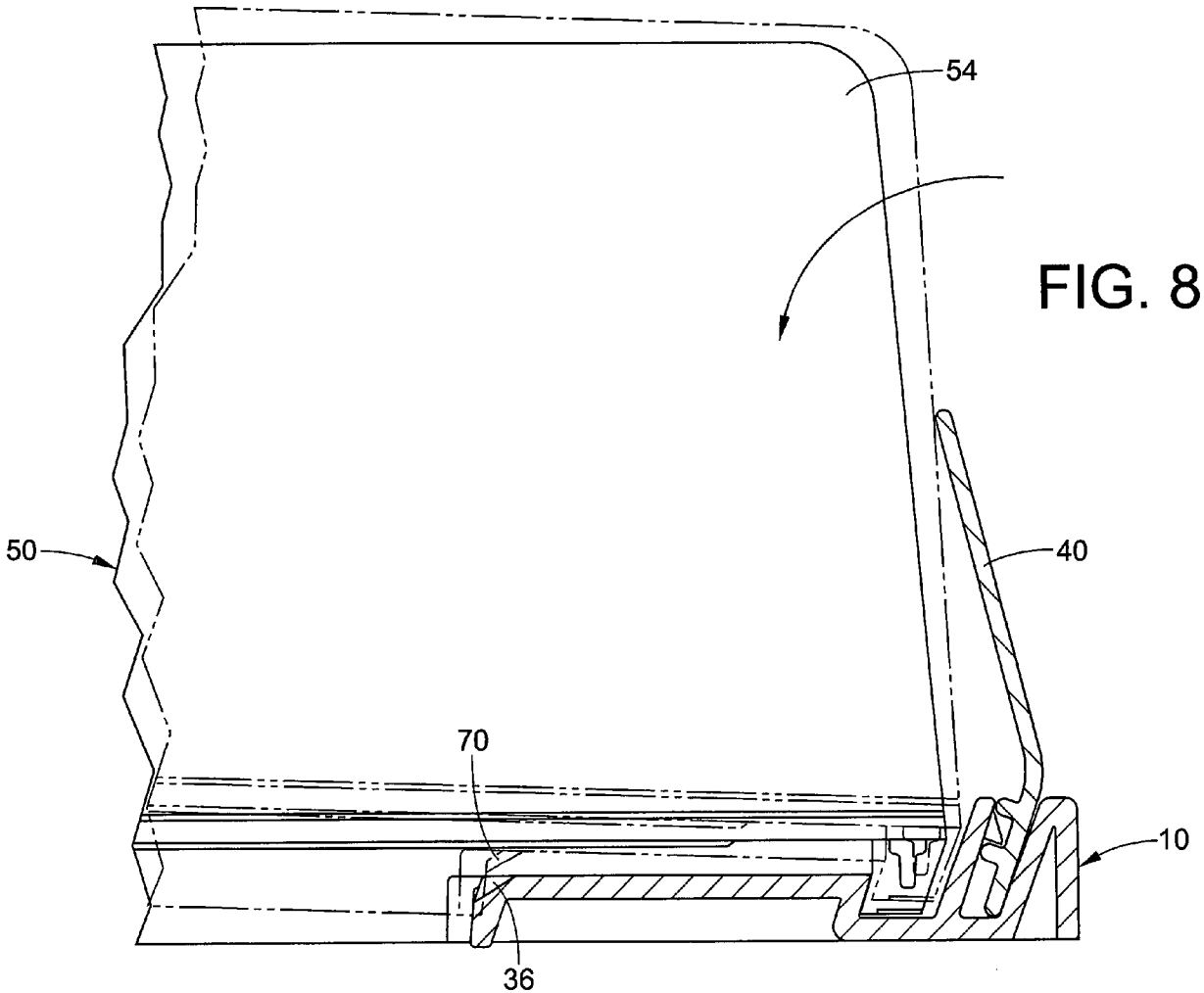
FIG. 8 is an enlarged reverse view of a front portion of the system of FIG. 1 with the shelf divider in the process of becoming locked into place on the front rail or mounting member.

Mounted in the first groove 16 is a front fence 40, as can be seen in FIGS. 1 and 8. As shown in FIG. 1, a suitable conventional fastener 42 can extend through the opening 28 in the horizontal wall 20 of the mounting member 10 so as to secure the mounting member in place on a subjacent shelf A, which has suitable apertures for this purpose. It should be appreciated that a plurality of such openings 28 may be provided on the front rail 10. It should also be appreciated that the fastener 42 is located in the recessed portion 26 of the horizontal wall so as to not interfere with shelf dividers or pusher tracks secured to the front rail. It can be appreciated from FIG. 1 that the mounting member 10 can be somewhat L-shaped in side view. Of course, the mounting member could also have other shapes, if so desired.

In this embodiment, a shelf divider and pusher track, which is of one piece, is disclosed. However, it should be appreciated that separate shelf divider walls and pusher tracks can also be employed with the mounting member or front rail 10 disclosed herein.

Figure 6:
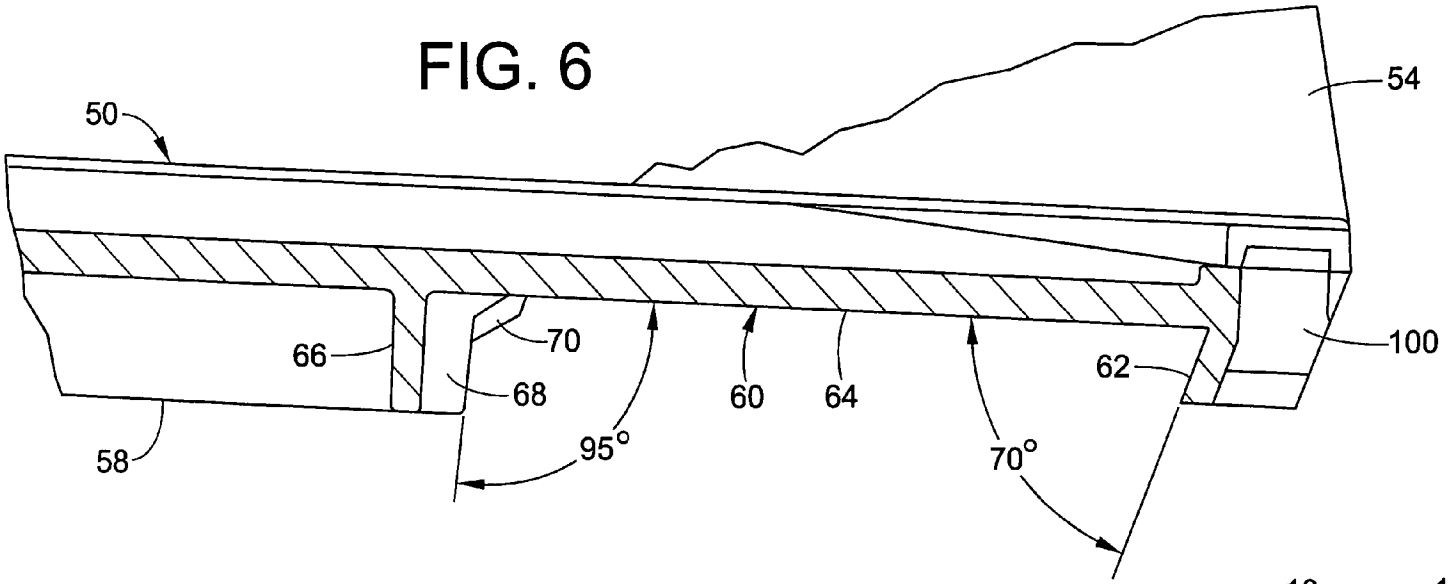
FIG. 6 is a greatly enlarged reverse cross-sectional view, partially broken away, of a portion of the shelf divider of FIG. 1.

With continued reference to FIG. 1, a shelf divider 50 is mounted on the mounting member or front rail 10. The shelf divider includes a horizontally oriented base wall 52 and a vertically oriented divider wall 54. Located on a bottom face 58 the base 52 is a transversely extending slot 60. With reference now again to FIG. 6, the slot 60 includes a front face 62, a roof 64 and a rear face 66. Extending forwardly from the rear face are a set of rear protrusions 68. Defined on such protrusions is a second row or set of teeth 70.

Figure 3:
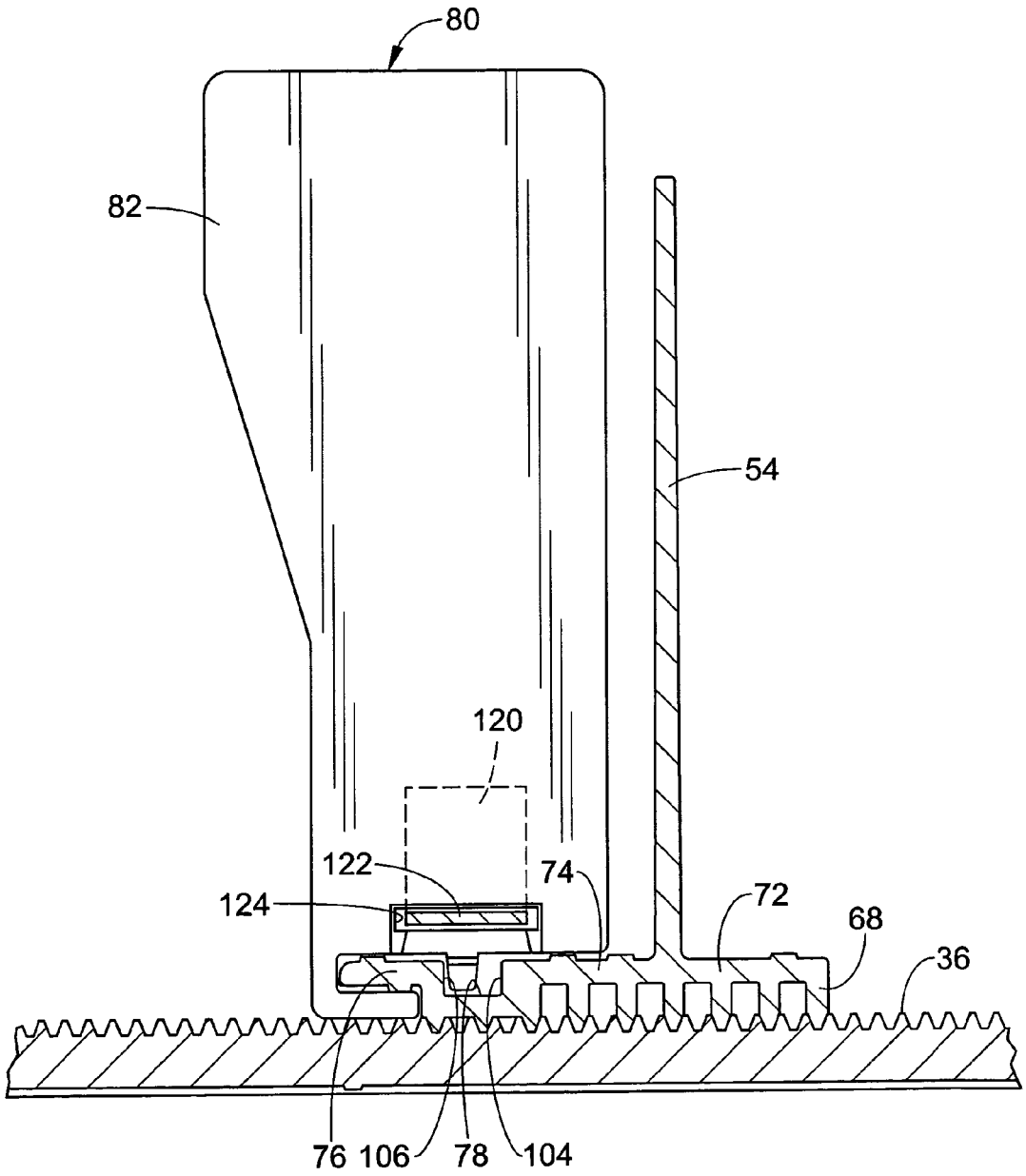
FIG. 3 is an enlarged cross-sectional view of the system of FIG. 2 along line 3-3.
Figure 4:
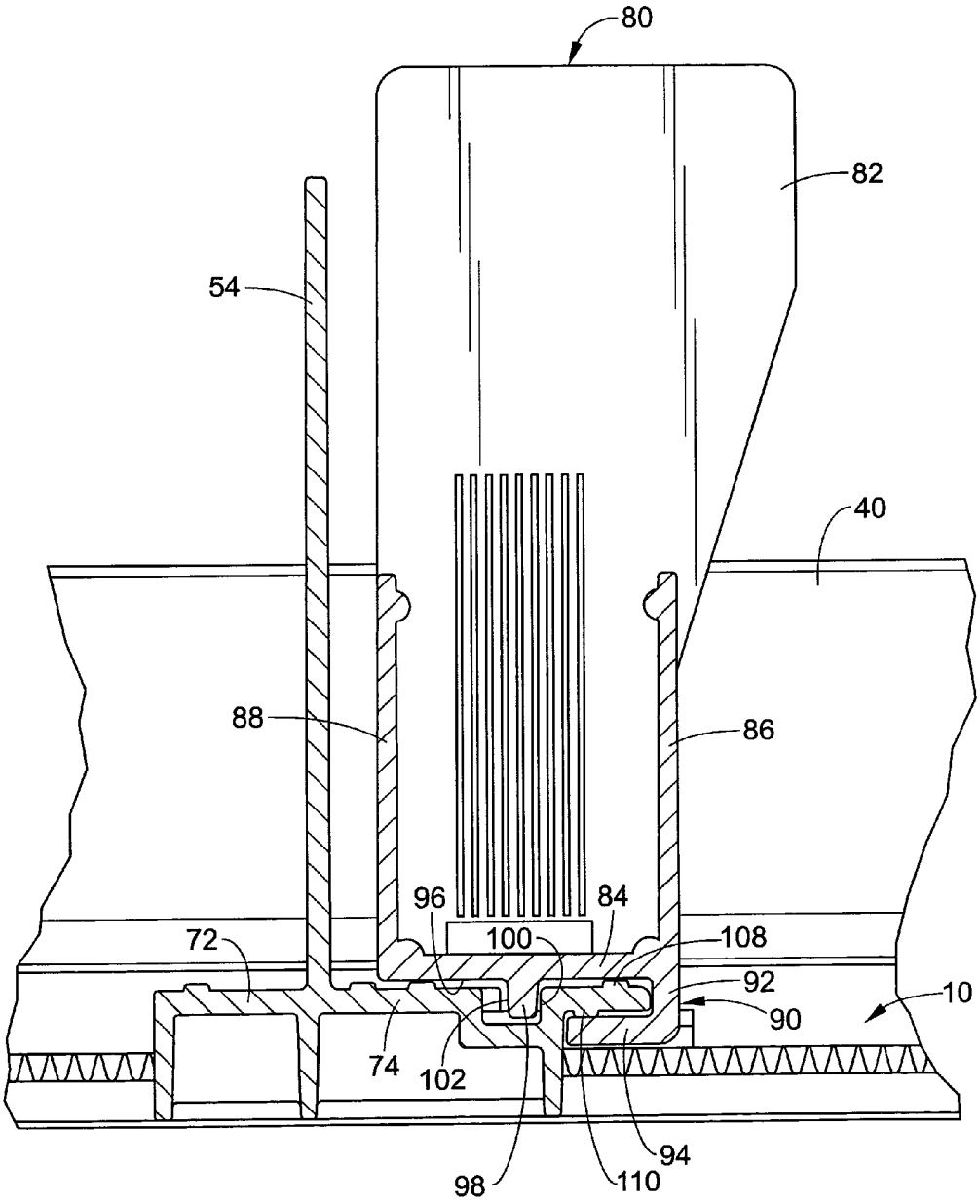
FIG. 4 is an enlarged cross-sectional view of the system of FIG. 2 along line 4-4.

With reference now to FIG. 3, the shelf divider base wall 52 has a first section 72 and a second section 74. Defined on the second section is a flange or rail 76. Positioned adjacent the flange is a channel or groove 78. A pusher member 80 is slidably mounted on the base wall second section 74. With reference now to FIG. 4, the pusher member 80 includes a vertically extending pusher wall 82 and a base wall 84. Connecting the pusher wall and the base wall are first and second brace walls or gussets 86 and 88.

Figure 5:
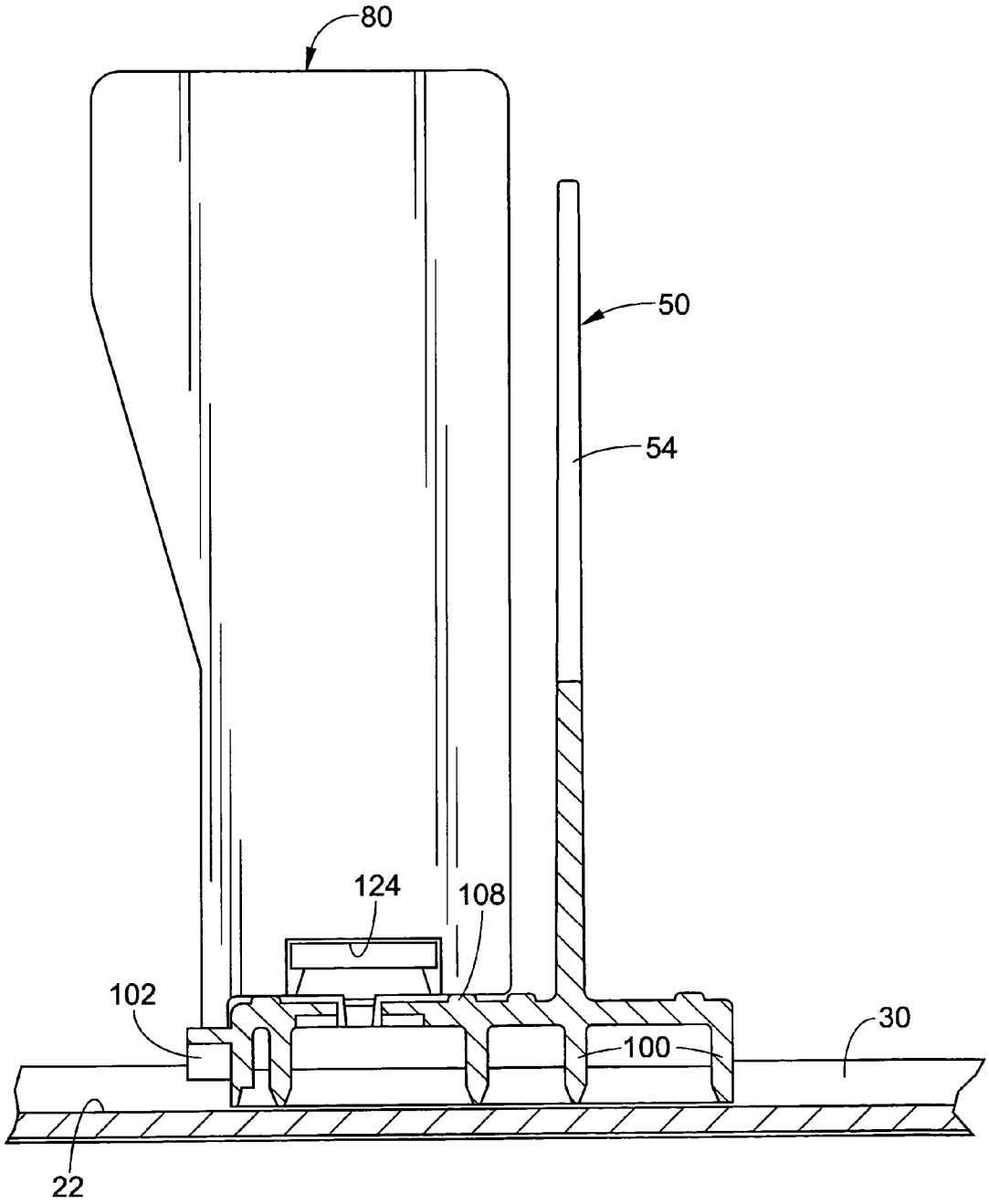
FIG. 5 is an enlarged cross-sectional view of the system of FIG. 2 along line 5-5.

Depending from the base wall 84 is a foot 90. In this embodiment, a first portion 92 of the foot can be aligned with the first brace wall 86, as best shown in FIG. 4. A second portion or flange 94 of the foot can be oriented approximately normal to the first portion 92 and can be parallel to a plane of the base wall 84. Thus, a somewhat U-shaped section is formed for accommodating the flange or rail 76 extending from the base wall second section 74. Protruding from a lower surface 96 of the base wall 84 is a rib or protrusion 98. The protrusion includes a pair of side walls 100 and 102. It should be apparent from FIGS. 4 and 5 that the second side wall 102 is spaced a considerable distance from a first side wall 104 of the channel or groove 78 but that the protrusion first side wall 100 is located adjacent the groove second side wall 106. Located on the base wall second section 74 are top rails 108 and bottom rails 110, as illustrated in FIGS. 4 and 5.

With reference again to FIG. 3, a coil spring 120 can be housed on the pusher member 80. More particularly, the coil spring is supported on the base wall 84 between the pair of brace walls. A section 122 of the coil spring extends through a slot 124 in the pusher wall 82. A front end (not illustrated) of the coil spring can be secured to a front portion of the shelf divider. In use, as the pusher 80 reciprocates on the track formed by a flange 76, the channel 78 and the rails 108 and 110, the pusher base 84 and foot 90 ride on the top and bottom rails 108 and 110 such that the lower surface 96 of the base wall contacts at least one of the top rails 108 while the second portion 94 of the foot or guide contacts the bottom rail 110. Due to the cooperation of the foot 90 and the protrusion 98 with the base wall second section 74, the pusher 80 can not be lifted away from the track. Rather, the pusher must be slid to an end of the track to be subsequently removed.

Figure 9:
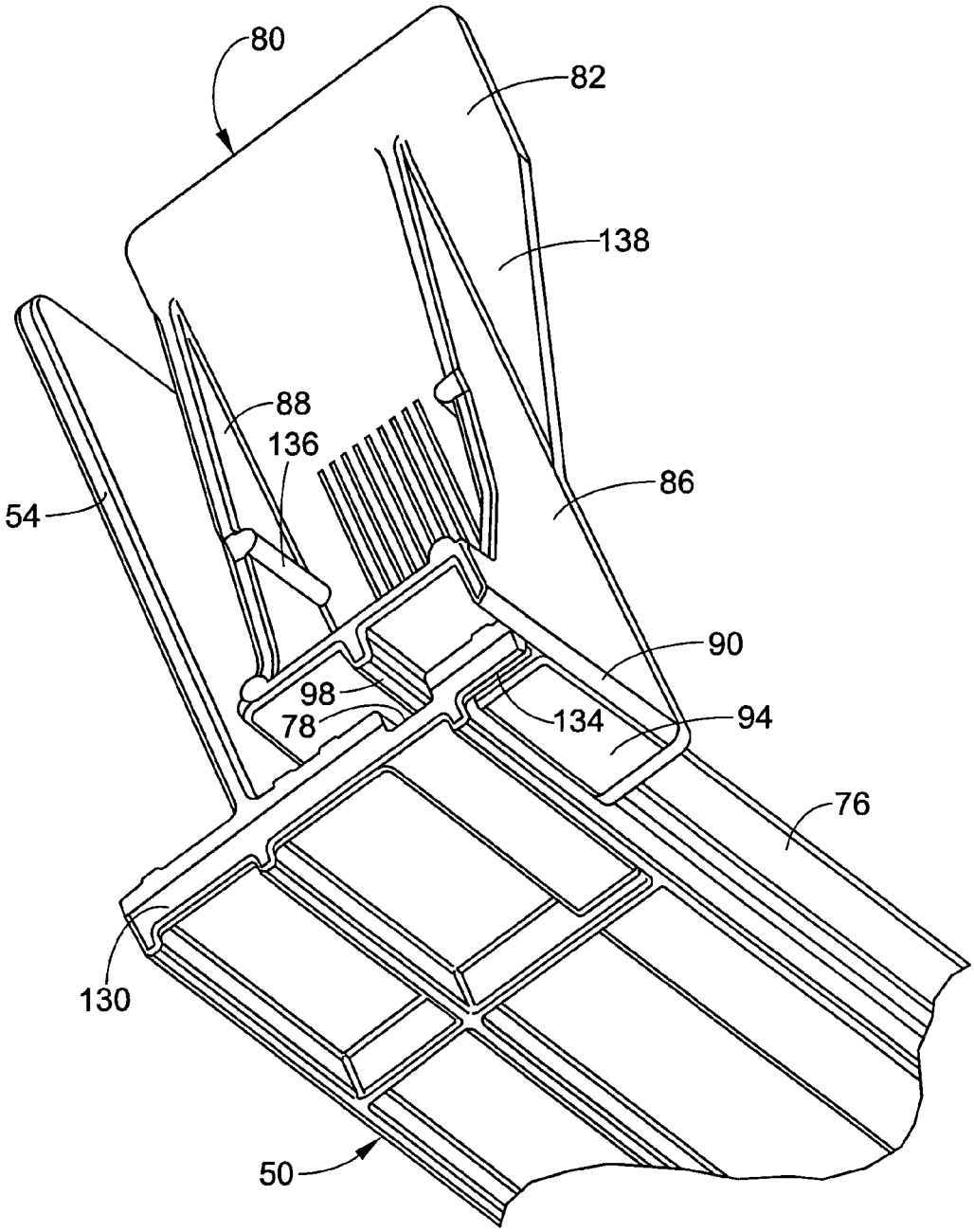
FIG. 9 is an enlarged perspective view of a rear end of the shelf divider of FIG. 1 with a paddle thereof being shown in a fully retracted position.

With reference now to FIG. 9, it can be seen that when the pusher 80 is fully retracted, it can at least partially extend past a rear wall 130 of the shelf divider 50. However, the pusher does not fall off the shelf divider as a rear edge 132 of the foot second portion 94 contacts a depending section 134 of the rear wall 130. Since the pusher can be retracted past the rear end of the divider member 50, a system of the present invention can be used on a shelf that is somewhat deeper than is the length of the divider 50. Thus, the present system is capable of accommodating shelving of the varying depths. Of course, if the shelf is no deeper than the length of divider 50 then no part of the pusher will be able to retract past the end of the divider as the pusher will contact the rear surface of the shelf. In order to stiffen the two brace walls 86 and 88, stiffening ribs 136 can be employed, as is shown in FIG. 9. Moreover, the pusher wall 82 can have an enlarged upper end 138 in order to better accommodate wider merchandise that is being urged forwardly on the track by the pusher member.

With reference again to FIGS. 6 and 7, it can be seen that the angle of the front face 30 in relation to a plane of the second groove 22 can be, for example, 71°. In contrast, the angle between the front face 62 and the roof 64 of the slot 60 located in the shelf divider 50 can be 70°. As a result, when the shelf divider is completely seated on the mounting member 10 a pinching action takes place between the front face 62 and roof 64 of the divider 50 and the front face 30 and top face 32 of the mounting member 10. Such pinching action locks the shelf divider 50 onto the mounting member to retard a sideward sliding motion of the shelf divider on the mounting member. Such pinching action is possible due to the resilient nature of the materials from which the shelf divider and the mounting member are made. If desired, these two components can be made of suitable conventional resilient materials, such as known thermoplastic materials. These will allow some relative flexing between the two as the shelf divider is mounted on or detached from the mounting member or rail. The two components can be made from the same material or from different materials. It should, of course, be appreciated that other suitable angles could be provided on the interengaging surfaces of the mounting member and the shelf divider to provide the desired pinching action or locking action.

Of course, such sideward sliding movement is also retarded by the interengaging sets of teeth 36 and 70 on the mounting member and the shelf divider respectively. To this end, the back face 34 is angled forwardly by 5° from the vertical. Similarly, the rear protrusions 68 are angled forwardly by 5° from the vertical. Thus, there is a mating engagement of the mounting member back face with the rear protrusion 68 of the shelf divider 50. In this embodiment, the pinch point occurs only at the engagement of the mounting member front face 30 with the shelf divider front face 62. However, it should be appreciated that such pinch points could be located at other positions along the engagement surfaces of the mounting member and shelf divider.

As is best seen from FIG. 8, the locking action of the shelf divider 50 on the mounting member 10 takes place when the shelf divider is fully lowered onto the mounting member. However, when a rear end of the shelf divider is slightly lifted, the shelf divider is rotated in relation to the mounting member. This action unlocks the shelf divider from the mounting member, disengages the two sets of teeth 36 and 70 and allows the shelf divider to be moved along the mounting member to a desired location. To this end, the shelf divider can either be slid along the mounting member or simply pulled away from the mounting member and laterally moved to the desired location and then reconnected with the mounting member.

Figure 10:
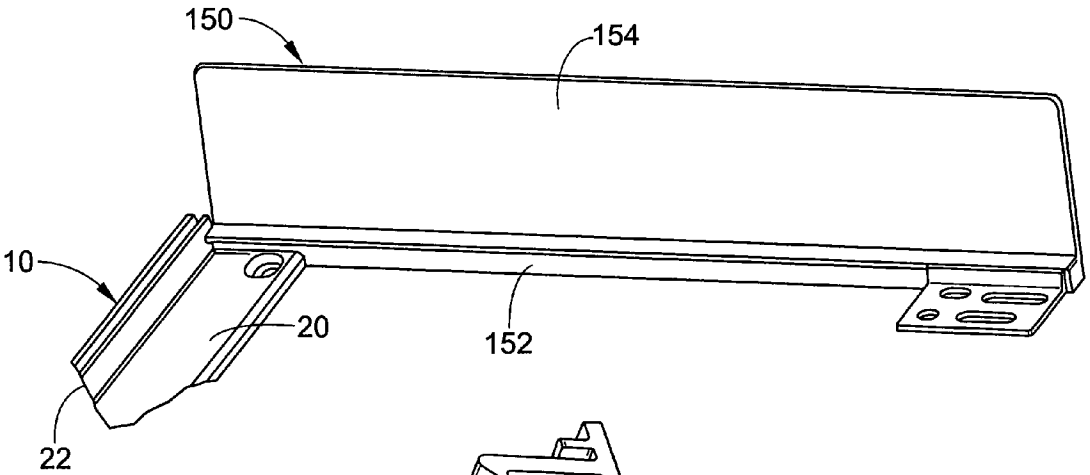
FIG. 10 is a perspective view of an end divider mounted to the front rail of FIG. 1.
Figure 11:
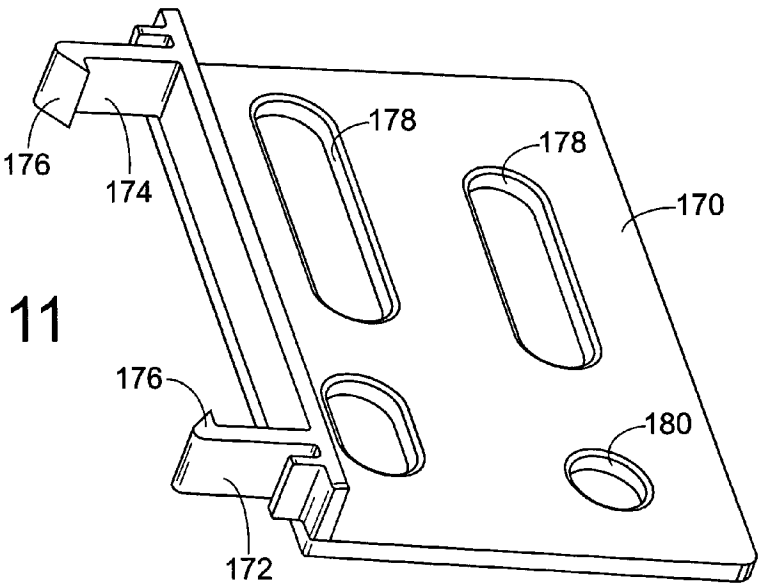
FIG. 11 is an enlarged perspective view of a mounting foot of the end divider of FIG. 10.
Figure 12:
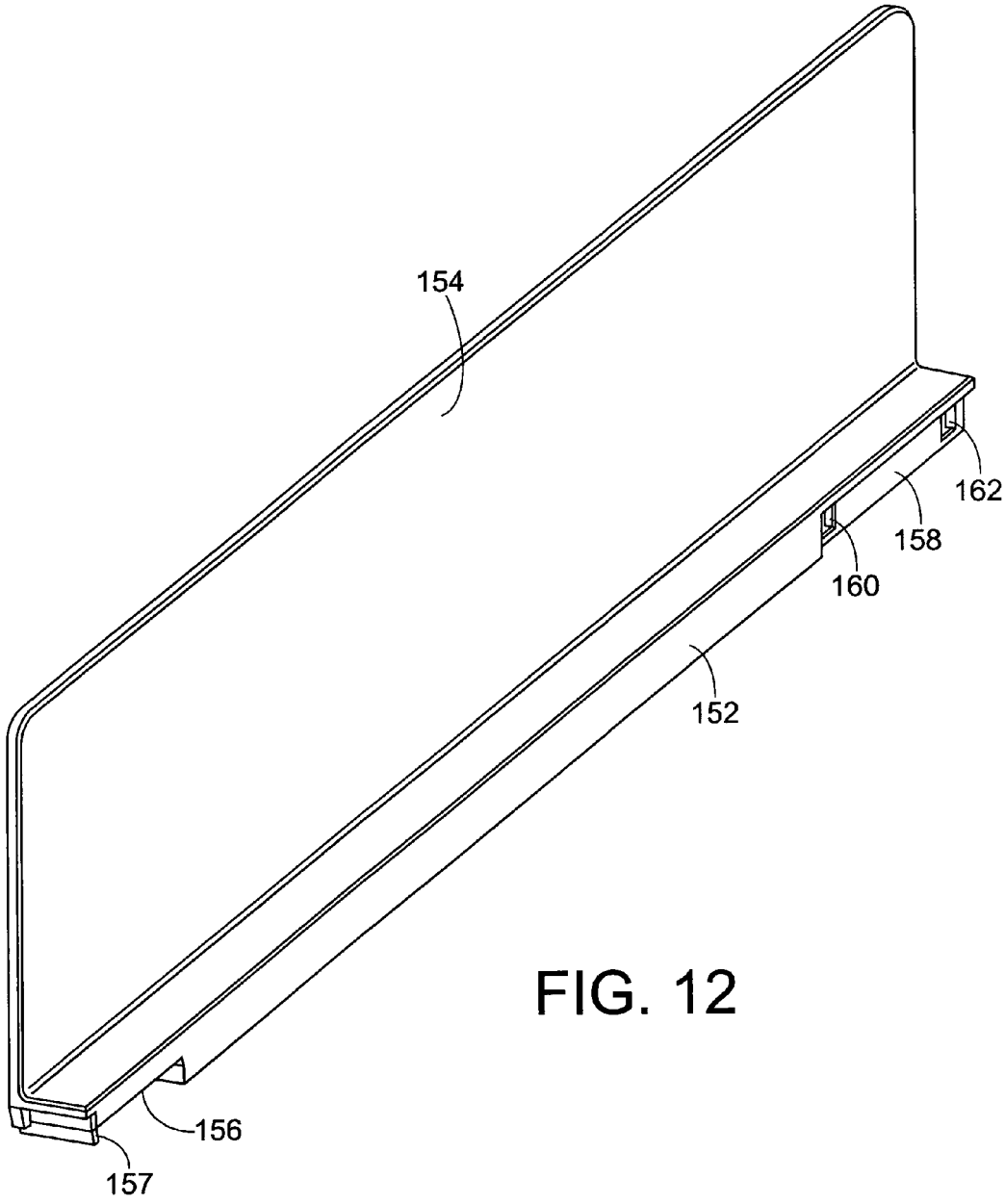
FIG. 12 is an enlarged perspective view of the end divider of FIG. 10, without the mounting foot.

With reference now to FIG. 10, an end wall 150 for the shelf divider system includes a base 152 and an upright portion 154. With reference also to FIG. 12, a transversely extending slot 156 is located adjacent a first end of the end wall 150. The slot 156 is adapted to accommodate the horizontal wall 20 of the mounting member 10. A front edge 157 of the divider is seated in the second groove 22. Also provided for the end wall 150 is a recessed area 158. Located in the recessed area are spaced first and second sockets 160 and 162. Cooperating with the end wall 150 is a flange 170, as illustrated in FIG. 11. The flange includes a first arm 172, and, spaced therefrom, a second arm 174. Each of these arms have a tooth 176 positioned on their distal end. The arms are adapted to extend through the sockets 160 and 162 so that the teeth protrude past the far edge of the base in order to clip or lock the flange 170 into place in the end wall 150. Provided on the flange are a plurality of slots 178 and apertures 180. These are meant to accommodate suitable conventional fasteners (not shown) in order to secure the end wall in place on the associated shelf.

Figure 13:
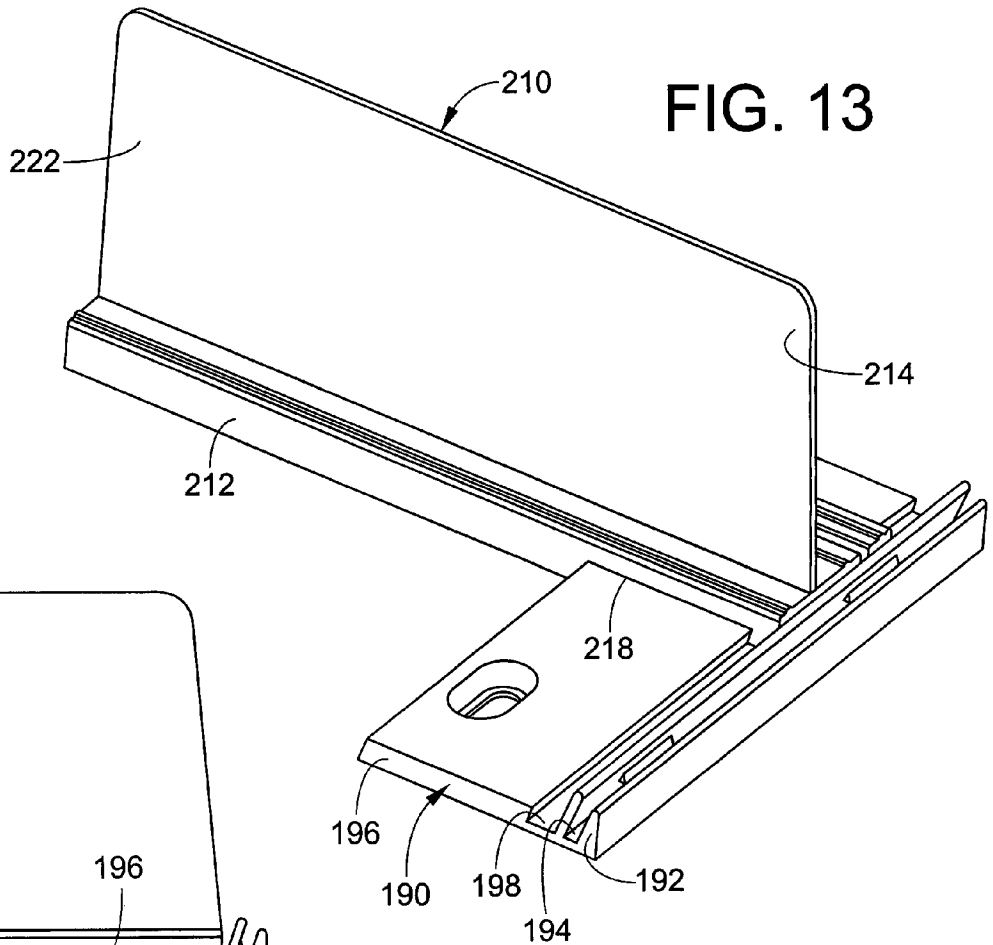
FIG. 13 is a perspective view of a shelving system with a shelf divider and a mounting member or rail according to a second embodiment of the present invention.
Figure 14:
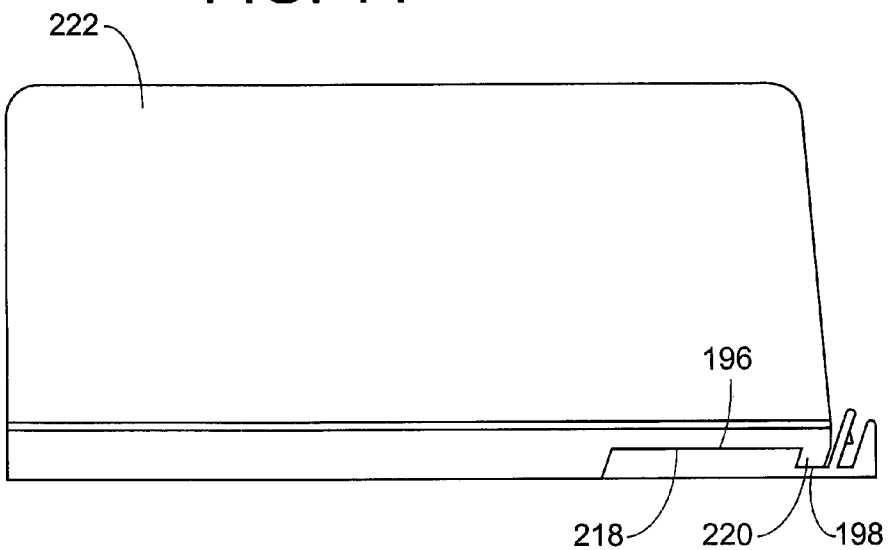
FIG. 14 is a side elevational view of the system of FIG. 13.

With reference now to FIG. 13, a second embodiment of a shelf divider system according to the present invention is there illustrated. In this embodiment, a rail or mounting member includes a vertically oriented wall 192 having a first groove 194 and a horizontally oriented wall 196 as well as a second groove 198. Selectively secured to the rail is a divider 210 having a base wall 212 and a vertically oriented dividing wall 214. A transverse slot 218 extends across a bottom surface of the base. The base thus has a front edge 220 which is adapted to fit into the second groove 198 while the slot extends over the horizontal wall 196, as best shown in FIG. 14. In this embodiment, no teeth are employed. Rather, a smooth set of engaging walls is disclosed in this embodiment. Thus, the set of engaging walls can be even, free from irregularities, roughness or projections. The locking feature is achieved by suitably configuring the engaging surfaces of the slot and the mounting member horizontal wall, along the lines discussed in connection with FIGS. 6 and 7 hereinbefore.

In other words, a locking engagement can be achieved when the divider 210 is fully lowered onto the mounting member 190 because of the differing angles provided for the mating surfaces of the mounting member and the divider. Even a 1° difference in the angles of the front face 198 of the horizontal wall 190 and the front face of the slot 218 is adequate to provide the desired pinching or locking action. Such a 1° difference was disclosed in the embodiment of FIGS. 6 and 7. Of course, other suitable angular relationships between the mating faces could also be employed. In order to detach the divider 210 from the mounting member 190, an installer merely has to raise a distal end 222 of the divider 210 thereby disengaging the locking feature. At this point, the divider can then be slid in relation to the mounting member 190 along the second groove 198. Alternatively, the divider can be detached from the mounting member and then moved in relation to it. It should be appreciated that the mounting member or rail can be secured to a subjacent shelf adjacent a front edge of the shelf or adjacent a rear edge of the shelf.

Figure 15:
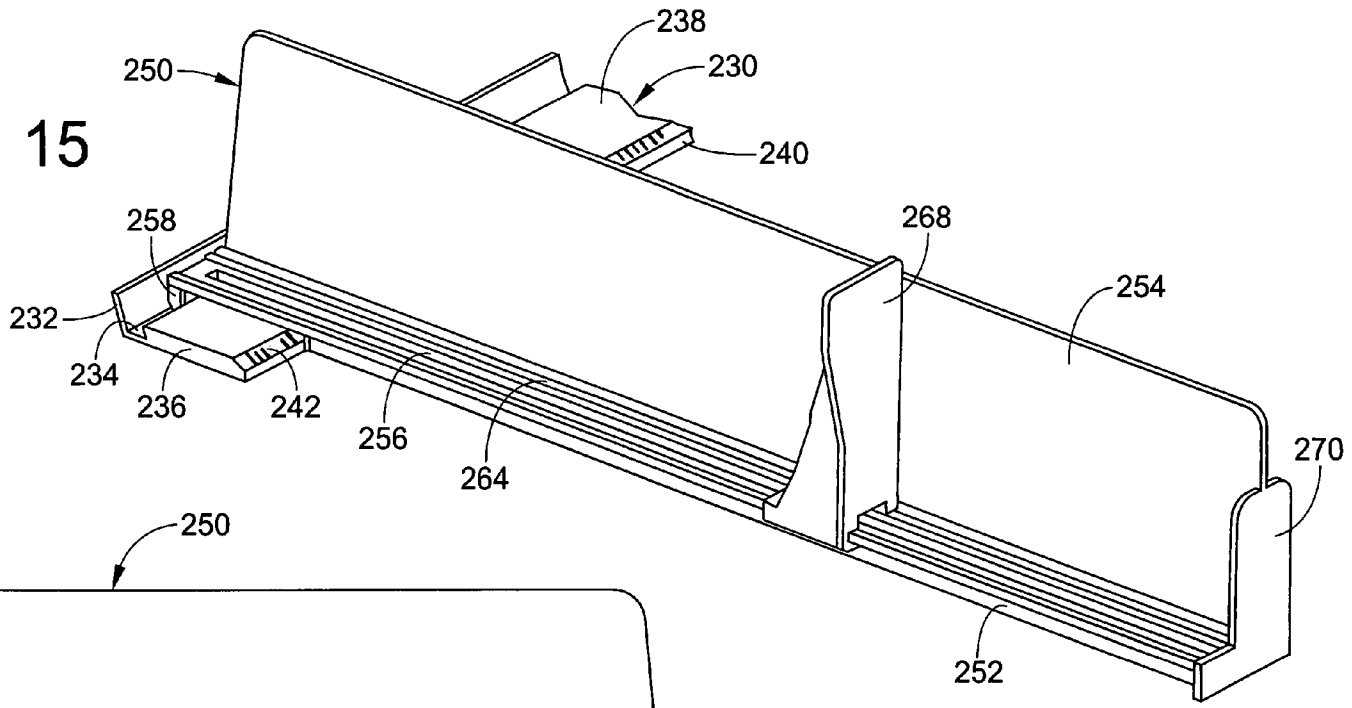
FIG. 15 is a perspective view of a shelf divider system employing a rear mounting member or rail and a shelf divider according to a third embodiment of the present invention.

With reference now to FIG. 15, a third embodiment of a shelf divider system according to the present invention is there illustrated. In this embodiment, a rear rail 230 is employed, instead of a front rail. The rear rail or mounting member includes a vertically oriented wall 232, a groove 234, and a horizontally oriented wall 236. The horizontally oriented wall includes a top surface 238 and a front surface 240. A first set of teeth 242 is located at the intersection of the top surface and front surface of the horizontally oriented wall 236. Selectively secured to the rear rail 230 is a divider 250. The divider includes a base wall 252 and a vertically oriented divider wall 254. A transverse groove or slot 256 is defined in the base wall 252 adjacent a rear end of the divider. The location of the slot 256 is such as to accommodate a depending rear end 258 of the divider base wall.

Figure 16:
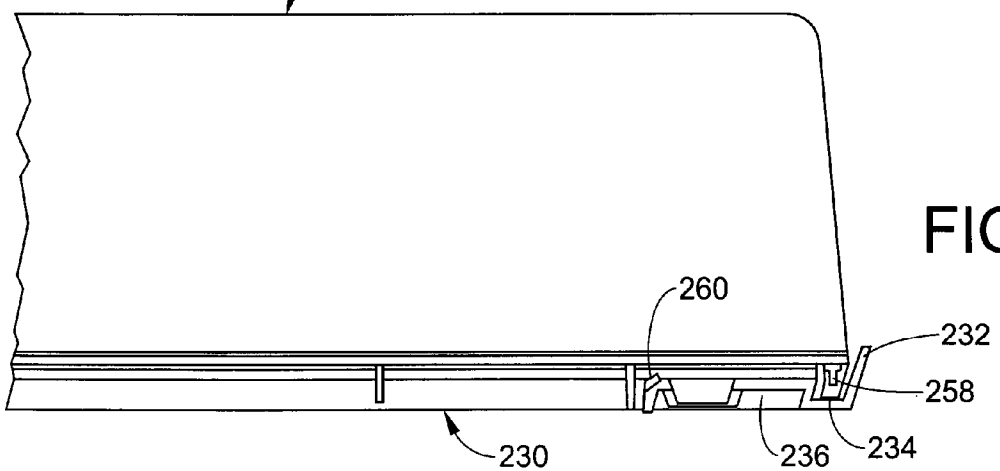
FIG. 16 is an enlarged reverse side elevational view of the system of FIG. 15.

With reference also to FIG. 16, the divider rear end 258 is shown as being seated in the groove 234. Provided in the slot 256 of the divider is a second set of teeth 260. These engage the first set of teeth 242 on the rear rail 230 so as to lock the divider in place on the rear rail. The divider 250 also includes a track 264 on which is mounted a pusher 268. The pusher can reciprocate along the track from adjacent the rear rail 230 to a forward position on a shelf on which the system is mounted. In this embodiment, a front wall 270 is provided for the track 264. The front wall can be of one piece with the divider 250 or it can be a separate element that is suitably connected to either the divider or to the shelf on which the divider is mounted.

With reference now to FIG. 17, a fourth embodiment of a mounting member 280 is there illustrated. In this embodiment, the mounting member includes a vertically oriented wall 282, a slot 284 and a horizontally oriented wall 286. The horizontally oriented wall includes a top surface 290 and a rear surface 292. A first set of teeth 294 is located at the intersection of the top surface and the rear surface. In this embodiment, a second set of teeth 296 is located in the slot 284. The teeth are spaced from a front surface 298 of the horizontally oriented wall and may contact a rear face 302 of the vertically oriented wall.

Figure 22:
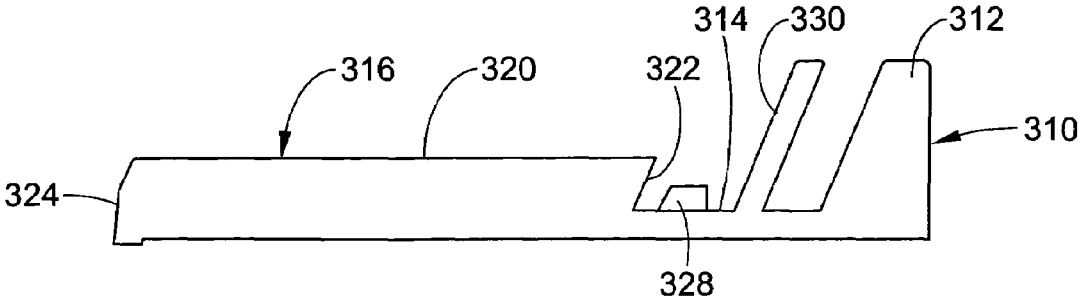
FIG. 22 is a reduced side elevational view of the mounting member rail of FIG. 18.

With reference now to FIG. 18, a fifth embodiment of a mounting member 310 according to the present invention is there illustrated. In this embodiment, the mounting member includes a vertically oriented wall 312, a slot 314 and a horizontally oriented wall 316. The horizontally oriented wall has a top surface 320, a front surface 322 and a rear surface 324. A set or row of teeth 328 is located in the slot 314. In this embodiment, the set of teeth does not contact either the front surface 322 of the horizontally oriented wall or a rear surface 330 of the vertically oriented wall. Rather, it is spaced from both. This can best be seen in FIG. 22 of the drawings.

Figure 19:
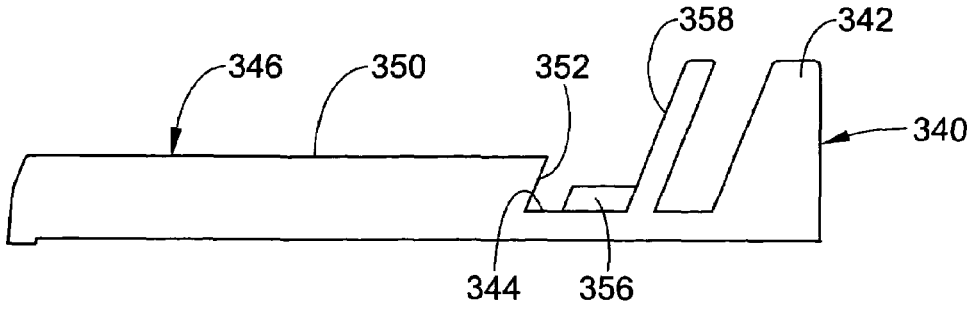
FIG. 19 is a reduced side elevational view of the rail of FIG. 17.

With reference now to FIG. 19, a sixth embodiment of a mounting member 340 according to the present invention is there illustrated. In this embodiment, the mounting member includes a vertical wall 342, a slot 344 and a horizontal wall 346. The horizontal wall includes a top surface 350 and a front surface 352. A set of teeth 356 is located in the slot 344. In this embodiment, the set of teeth contact a rear surface 358 of the vertical wall 342, but do not contact the front surface 352 of the horizontal wall 346.

Figure 20:
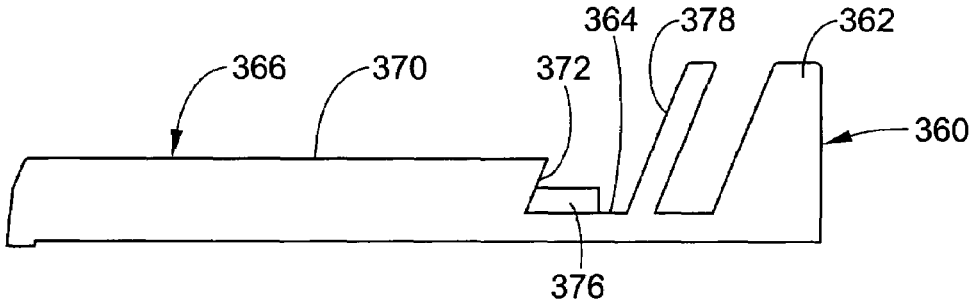
FIG. 20 is a side elevational view of a mounting member according to a sixth embodiment of present invention.

With reference now to FIG. 20, a seventh embodiment of a mounting member 360 is there illustrated. In this embodiment, the mounting member includes a vertical wall 362, a slot 364 and a horizontal wall 366. The horizontal wall has a top surface 370 and a front surface 372. A set of teeth 376 extend in the slot 364. The set of teeth contact the front surface 372 of the vertically oriented wall but do not contact a rear surface 378 of the vertically oriented wall.

Figure 21:
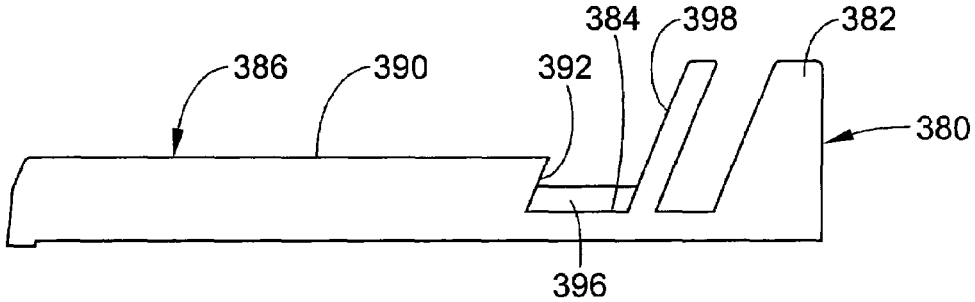
FIG. 21 is a side elevational view of a mounting member according to a seventh embodiment of the present invention.

With reference now to FIG. 21, an eighth embodiment of a mounting member 380 is there disclosed. In this embodiment, the mounting member comprises a vertical wall 382, a slot 384 and a horizontal wall 386. The horizontal wall includes a top surface 390 and a front surface 392. A set of teeth 396 extends along the slot 384. In this embodiment, the set of teeth extend from the horizontal wall front surface 392 to a rear surface 398 of the vertical wall. Thus, the set of teeth span the entire width of the slot 384.

Figure 23:
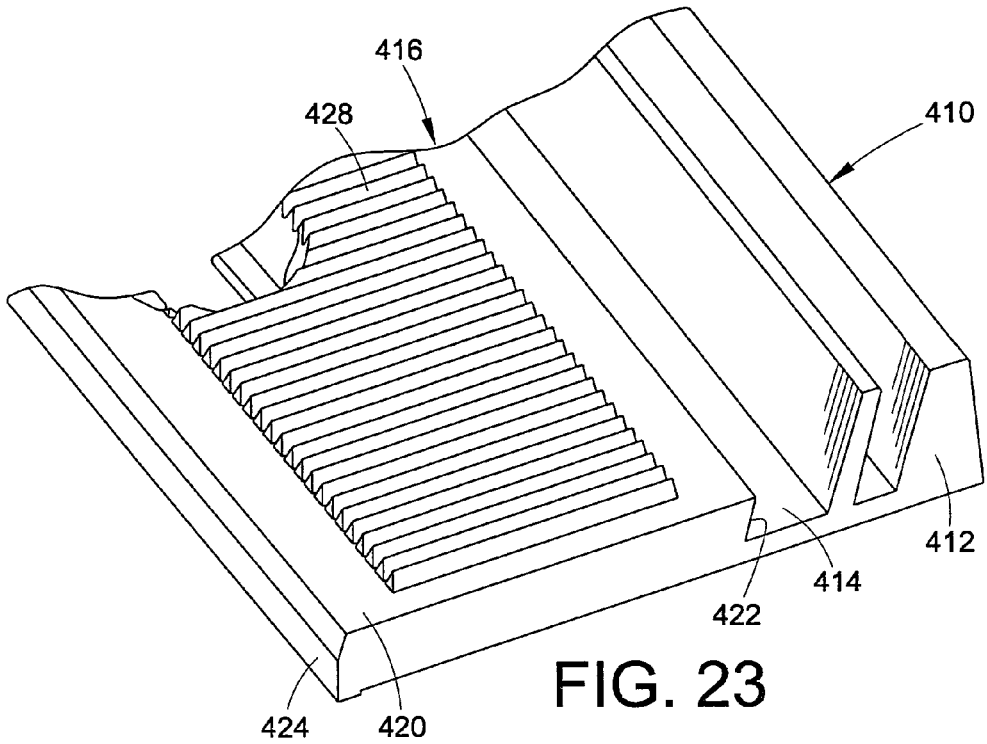
FIG. 23 is a perspective view of a mounting member according to a ninth embodiment of the present invention.

With reference now to FIG. 23, a ninth embodiment of a mounting member 410 according to the present invention is there illustrated. In this embodiment, the mounting member or rail includes a vertical wall 412, a slot 414 and a horizontal wall 416. The horizontal wall includes a top surface 420, a front surface 422 and a rear surface 424. In this embodiment, a set of teeth 428 is defined on the top surface 420 of the horizontal wall 416. No teeth are defined on either the front surface 422 or the rear surface 424 of the horizontal wall 416. Nor are there any teeth defined on the vertical wall 412.

Figure 24:
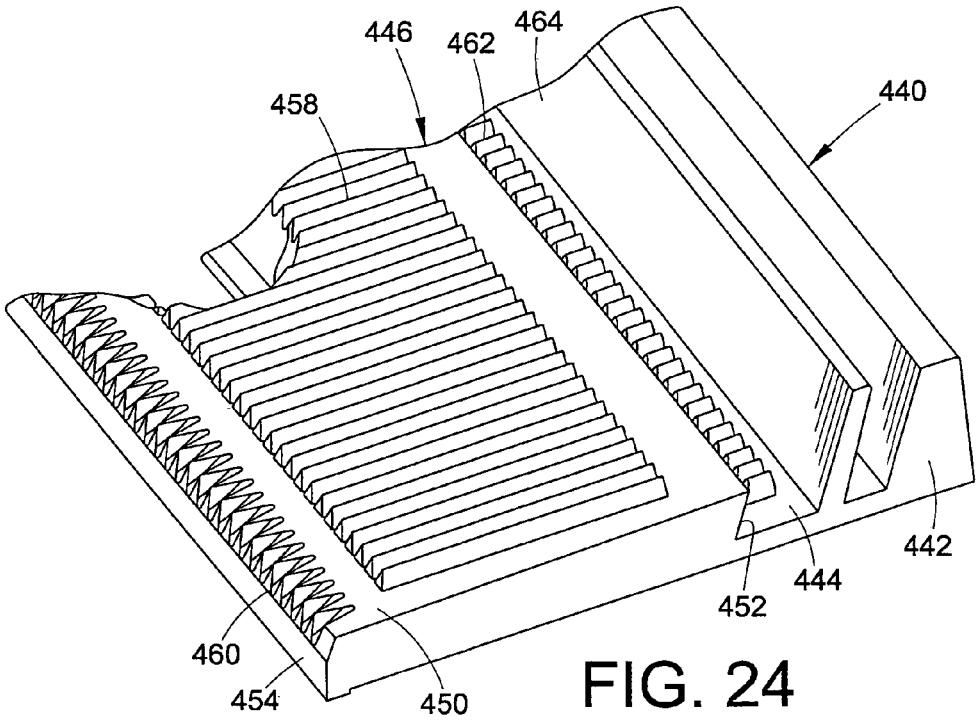
FIG. 24 is a perspective view of a mounting member according to a tenth embodiment of the present invention.

Finally, FIG. 24 illustrates a tenth embodiment of a mounting member according to the present invention. In this embodiment, the mounting member includes a vertical wall 442, a slot 444 and a horizontal wall 446. The horizontal wall includes a top surface 450, a front surface 452 and a rear surface 454. In this embodiment, a first set of teeth 458 is located on the top surface 450 on the horizontal wall. A second set of teeth 460 is located at the intersection of the horizontal wall top surface 450 and rear surface 454. A third set of teeth 462 is located in the slot 444. The third set of teeth does not contact either the front surface 452 of the horizontal wall or a rear surface 464 of the vertical wall. Rather, as in the embodiment illustrated in FIGS. 18 and 22, the third set of teeth is only connected to the base of the slot 444.

It should be appreciated that the various mounting members illustrated in, e.g. FIGS. 17-24 can be positioned at either the front edge of a shelf or the rear edge of the shelf, just as the mounting member of the embodiment of FIG. 1 is positioned adjacent a front edge of the shelf and mounting member of the embodiment of FIG. 15 is positioned adjacent the rear edge of the shelf.

Figure 25:
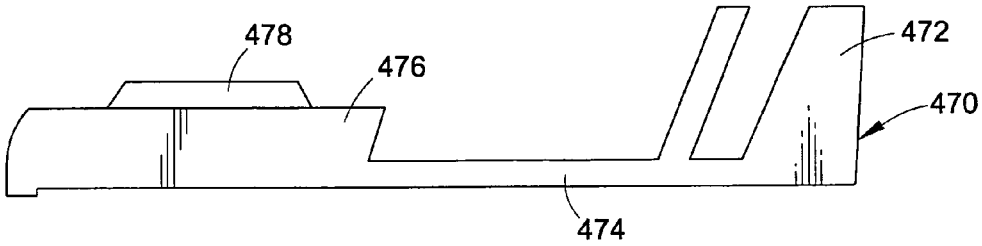
FIG. 25 is a side elevational view of a mounting member according to an eleventh embodiment of the present invention.

In the previous embodiments, the mounting member is shown to have a vertical wall, a horizontal wall and a slot defined between these two walls. However, it should be appreciated that other types of mounting member designs are also contemplated. For example, as disclosed in FIG. 25, a mounting member 470 can have a somewhat different configuration as well. In this embodiment, the mounting member 470 includes a vertical wall 472 and a horizontal wall 474. In this design, there is no separate slot defined between the vertical wall and the horizontal wall. Also, in this design, there is a raised area or plateau 476 located on the horizontal wall. Mounted atop the raised area 476 is a set or row of teeth 478. As in the earlier designs, the teeth can cooperate with suitable teeth located on a divider element, a track element or a combination divider and track assembly, as previously disclosed herein. It can be appreciated that the cooperating divider, track or combination divider and track assembly would need to be suitably configured in order to be accommodated on the mounting member.

Figure 26:
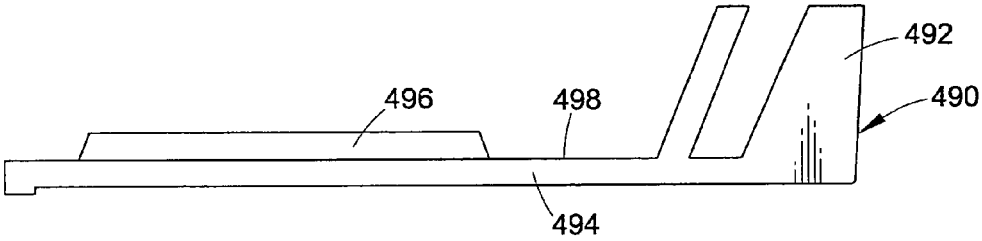
FIG. 26 is a side elevational view of a mounting member according to a twelfth embodiment of the present invention.

With reference now to FIG. 26, a yet twelfth version of a mounting member 490 is there disclosed. In this embodiment, the mounting member includes a vertical wall 492 and a horizontal wall 494. A set of teeth 496 is disposed on an upper surface 498 of the horizontal wall. In this design, the cooperating divider wall, pusher track or combination divider wall and pusher track is seated on the mounting member horizontal wall 494 and engages the teeth on the horizontal wall so as to retard a sidewards sliding motion of the cooperating member. It can be appreciated that the cooperating member would need to be suitably configured for this purpose.

Figure 27:
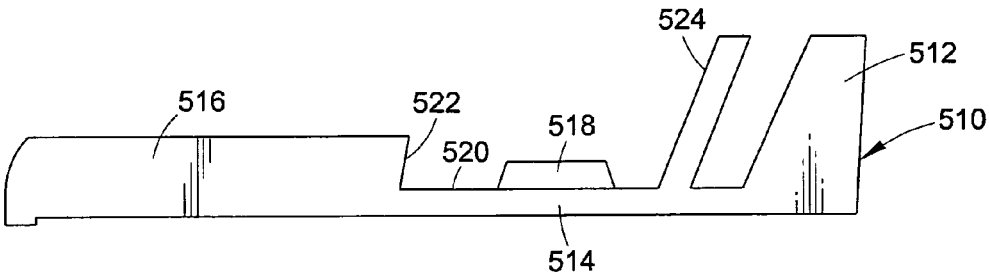
FIG. 27 is a side elevational view of a mounting member according to a thirteenth embodiment of the present invention.

In FIG. 27, there is disclosed a yet thirteenth embodiment of a mounting member 510 according to the present invention. In this embodiment, the mounting member includes a vertical wall 512 and a horizontal wall 514. The horizontal wall is provided with a raised area 516. In this embodiment, a row or set of teeth 518 are located on an upper surface 520 of the horizontal wall. The teeth are spaced both from the front surface 522 of the raised area 516 and a rear surface 524 of the vertical wall 512. For this embodiment, the cooperating divider wall, pusher track or combination divider wall and pusher track is suitably configured so as to engage the teeth 518. The cooperating member can also be configured to lockingly engage the raised area front surface 522, as discussed in connection with several of the embodiments previously mentioned.

Figure 28:
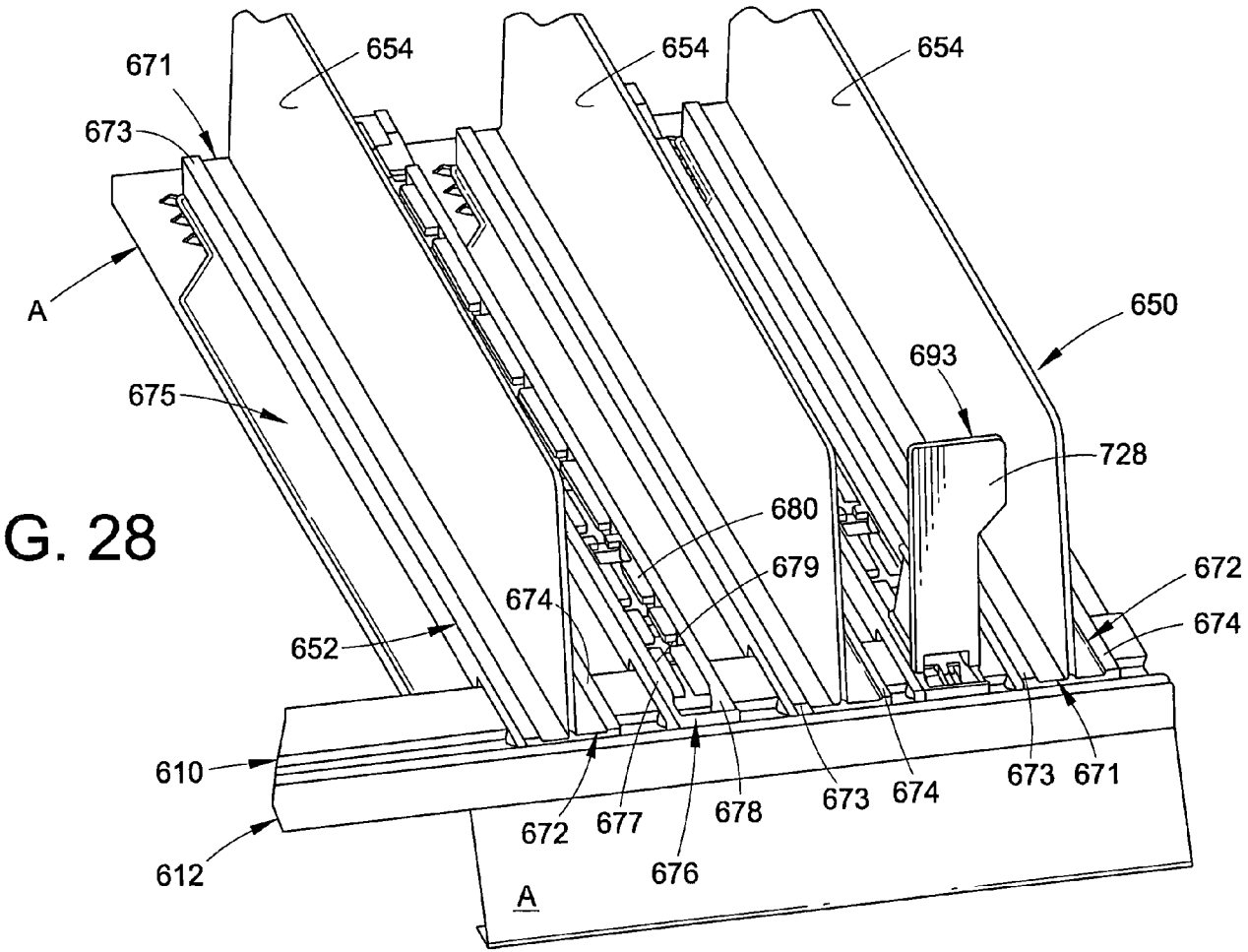
FIG. 28 is a front perspective view of a shelving system including a shelf divider mounted on the mounting member and a separate slidable track with a paddle or pusher thereon according to a fourteenth embodiment of the present invention.
Figure 29:
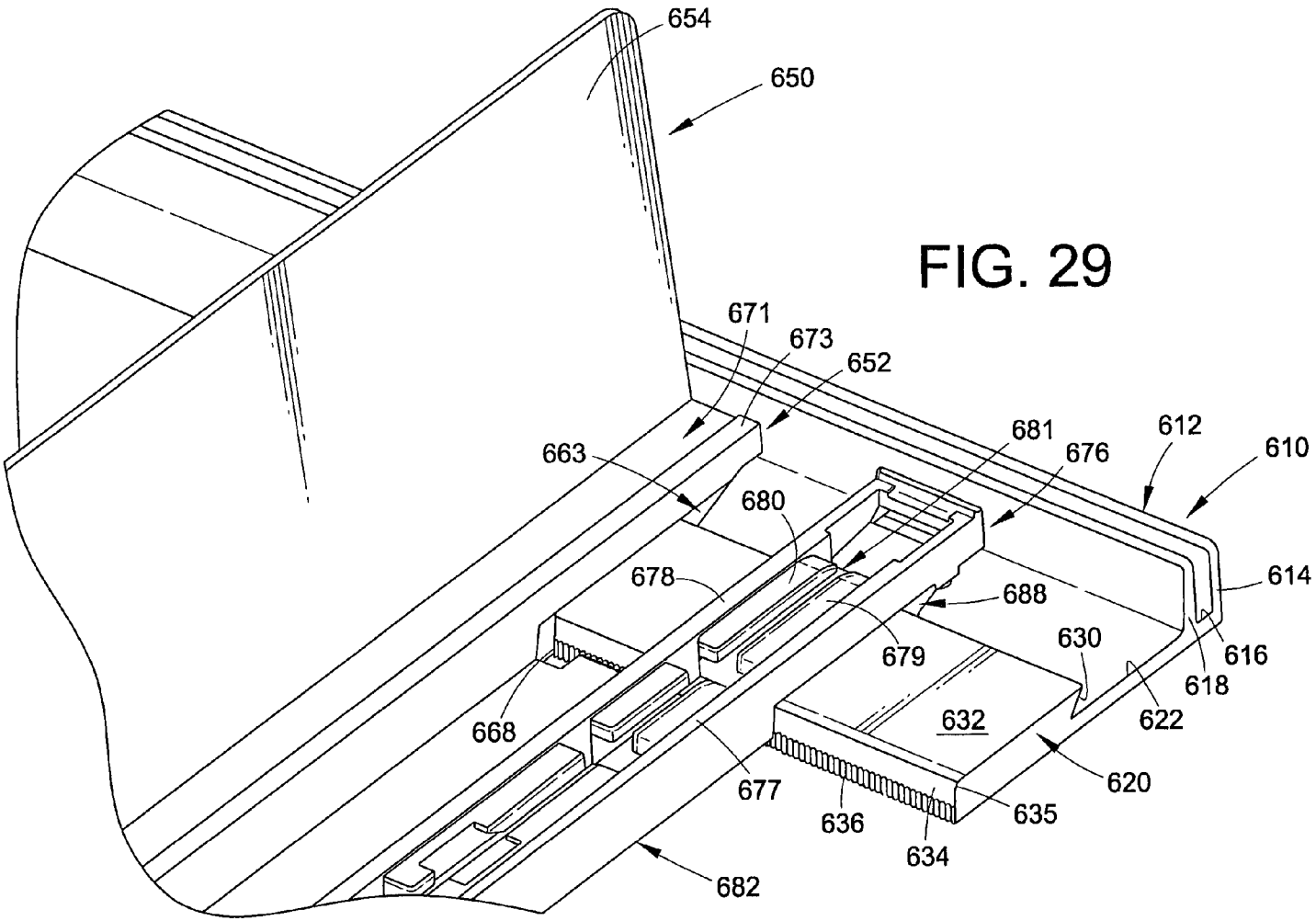
FIG. 29 is an enlarged rear perspective view of the system of FIG. 28.
Figure 30:
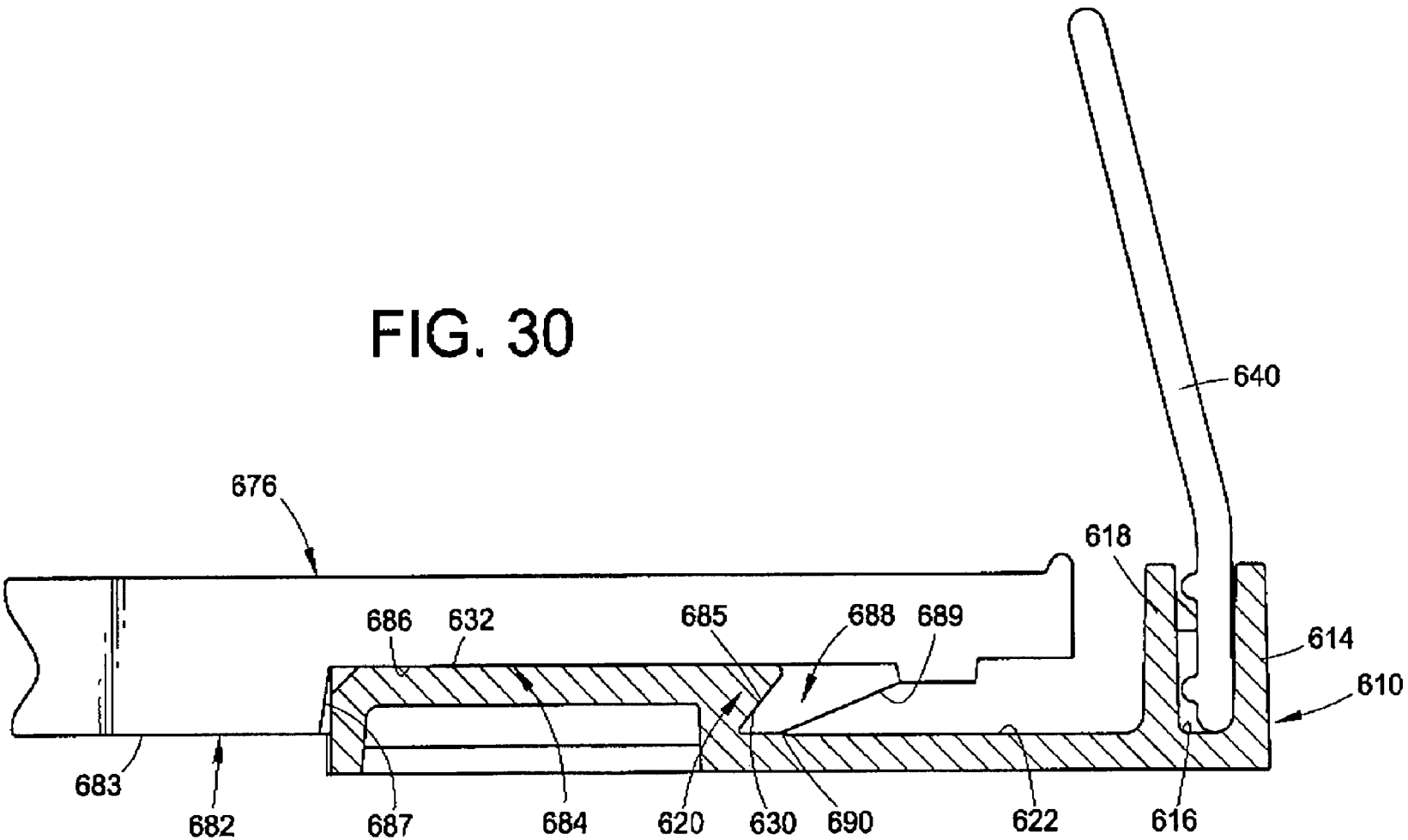
FIG. 30 is an enlarged side elevational view, partially in cross-section, of a front portion of the system of FIG. 28 along a first plane.
Figure 31:
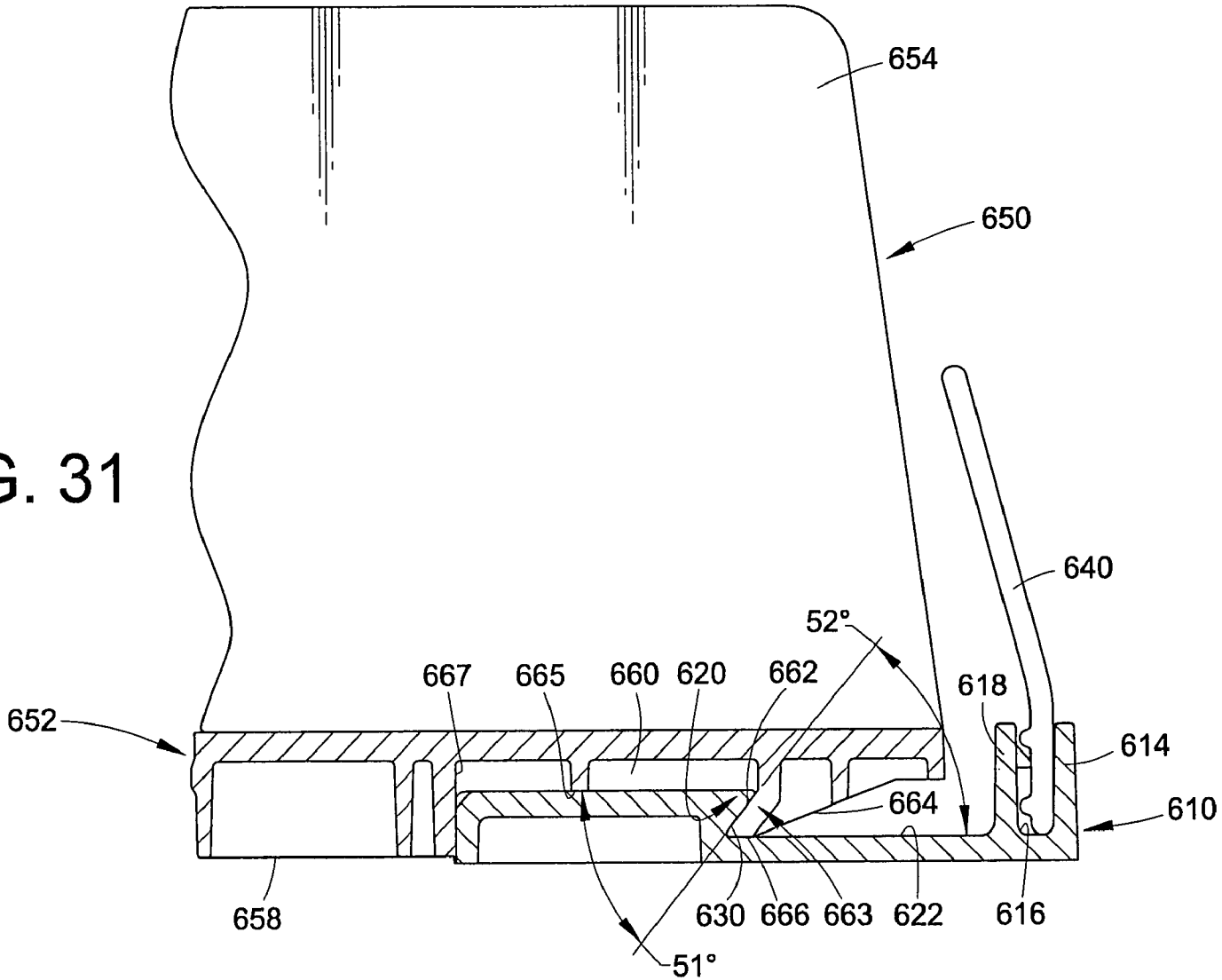
FIG. 31 is an enlarged side elevational view, partially in cross-section, of a front portion of the system of FIG. 28 along a second plane.

Referring now to FIG. 28, a fourteenth embodiment of a shelf divider system according to the present invention is illustrated. In this embodiment, a mounting member or front rail 610 includes a vertically oriented wall 612. With reference also to FIGS. 29-31, the vertically oriented wall 612 includes a first section 614, a first groove 616 and a second section 618. Also provided on the mounting member 610 is a horizontally oriented wall 620. Disposed between the horizontally oriented wall section and the vertical wall section 612 is a second groove 622. The wall 620 includes a front face 630, a top face 632 and a back face 634. Defined at the intersection of the top face 632 and the back face 634 is a rounded corner 635. Located on the back face 634 is a first row or set of teeth 636. In fact, the wall 620 may be termed a raised area or plateau, since its top face 632 is located at a higher elevation than is the surface of the groove 622.

Mounted in the first groove 616 is a front fence 640, as can be seen in FIGS. 30 and 31. A recessed portion with an opening can be located in the horizontal wall (not illustrated) for accommodating fasteners to secure the front rail 610 to the shelf A, as in the earlier embodiments. It can be appreciated from FIGS. 29 and 30 that the mounting member 610 can be somewhat L-shaped in side view. Of course, the mounting member 610 could also have other shapes, if so desired. In this embodiment, a shelf divider 650 and a pusher track 676, which are of two separate pieces, are disclosed.

Figure 37:
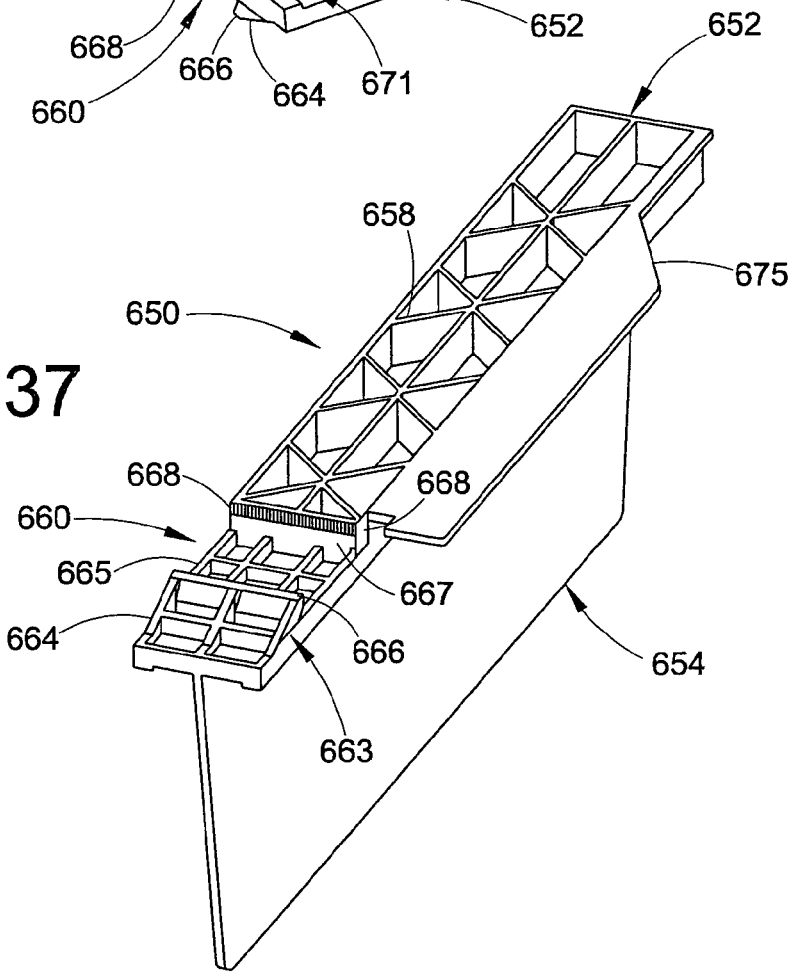
FIG. 37 is a bottom perspective view of the shelf divider of FIG. 36.

With reference now to FIGS. 28, 29 and 31, the shelf divider 650 is mounted on the mounting member 610. The shelf divider 650 includes a horizontally oriented base wall 652 and a vertically oriented divider wall 654. Located on a bottom face 658 of the base wall 652 is a transversely extending slot 660. The slot 660 includes a roof 665 and a rear face 667. The slot 660 also includes a front face 662 which is defined by a rear edge of a flange 663. The flange 663 extends transversely along the bottom face 658 of the base wall 652. The flange 663 includes a front face 664 and a bottom face 666. Extending forwardly from the slot rear face 667 are a set of rear protrusions or teeth 668 as best shown in FIG. 37. With reference now again to FIGS. 28 and 29, the shelf divider base wall 652 has a first side flange 671 and a second side flange 672. The side flanges 671 and 672 can include longitudinally extending rails or raised areas 673 and 674 for supporting merchandise thereon. The first side flange 671 can include an outwardly extending spacer member 675 which extends along a majority of the length of the side flange 671.

As shown in FIGS. 28-30, the separate track 676 can be slidably mounted to the mounting member 610. The track 676 includes a pair of elongated rails 677 and 678 extending longitudinally along the edges of a top surface of the track 676. A series of longitudinally extending guide sections 679 and 680 are positioned adjacent the rails 677 and 678 and define a central channel 681 therebetween. The track 676 includes a horizontally oriented base wall 682 which can rest upon the shelf. Located on a bottom face 683 of the base wall 682 is a transversely extending slot 684. With reference to FIG. 30, the slot 684 includes a roof 686 and a rear face 687. The slot 684 also includes a front face 685 which is defined by a rear edge of a flange 688. The flange 688 extends transversely along the bottom face 683 of the base wall 682. The flange 688 includes a front face 689 and a bottom face 690.

Figure 34:
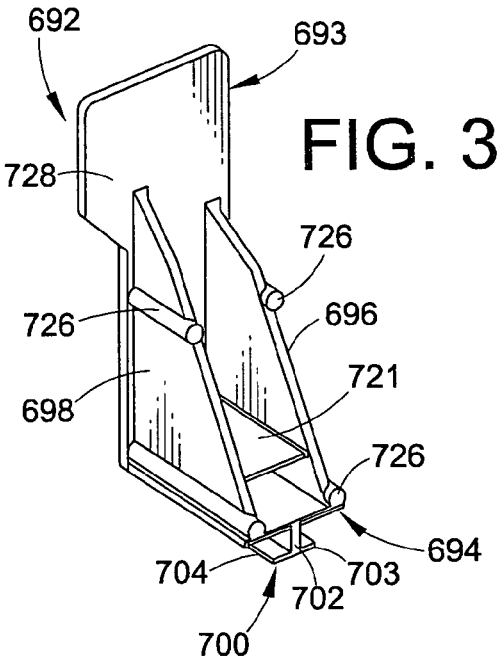
FIG. 34 is an enlarged rear perspective view of a paddle of FIG. 28.
Figure 35:
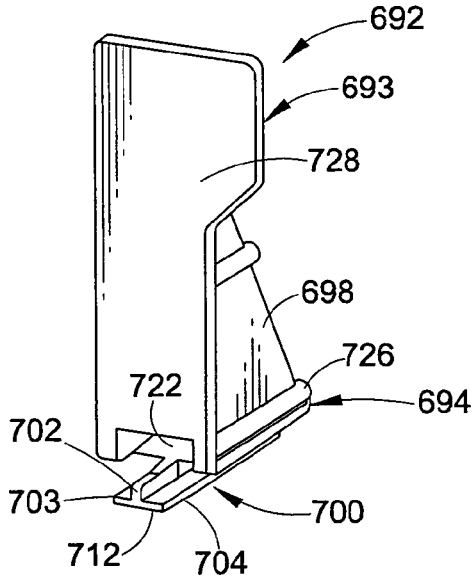
FIG. 35 is an enlarged front perspective view of the paddle of FIG. 34.
Figure 36:
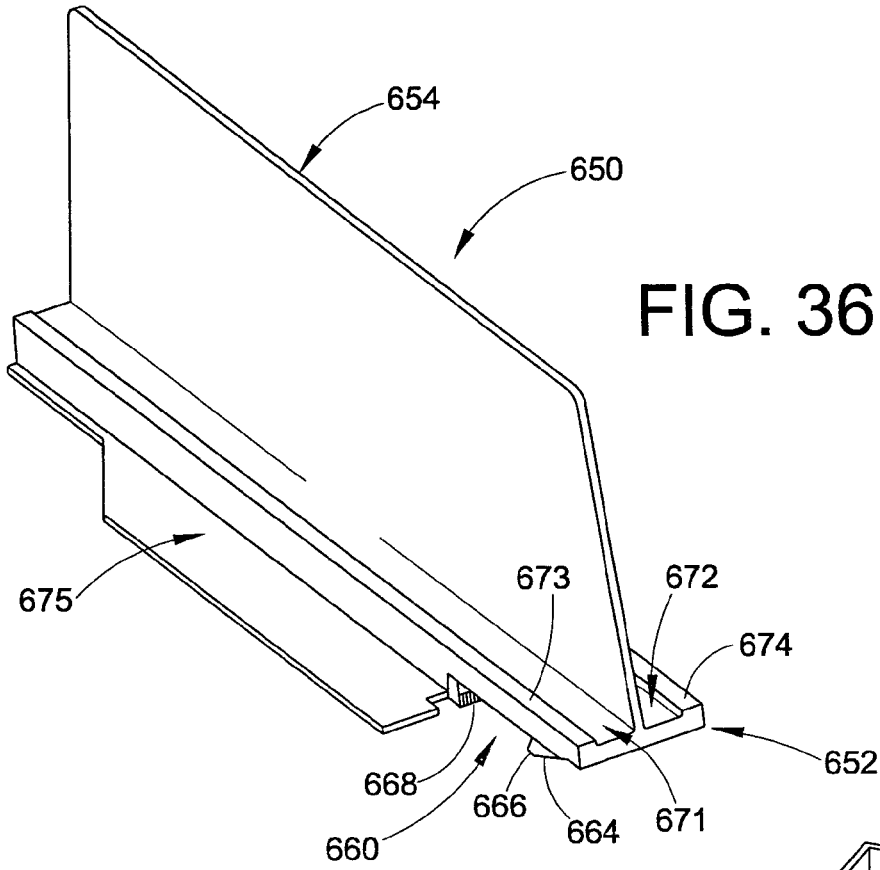
FIG. 36 is a front perspective view of a shelf divider of FIG. 28.
Figure 38:
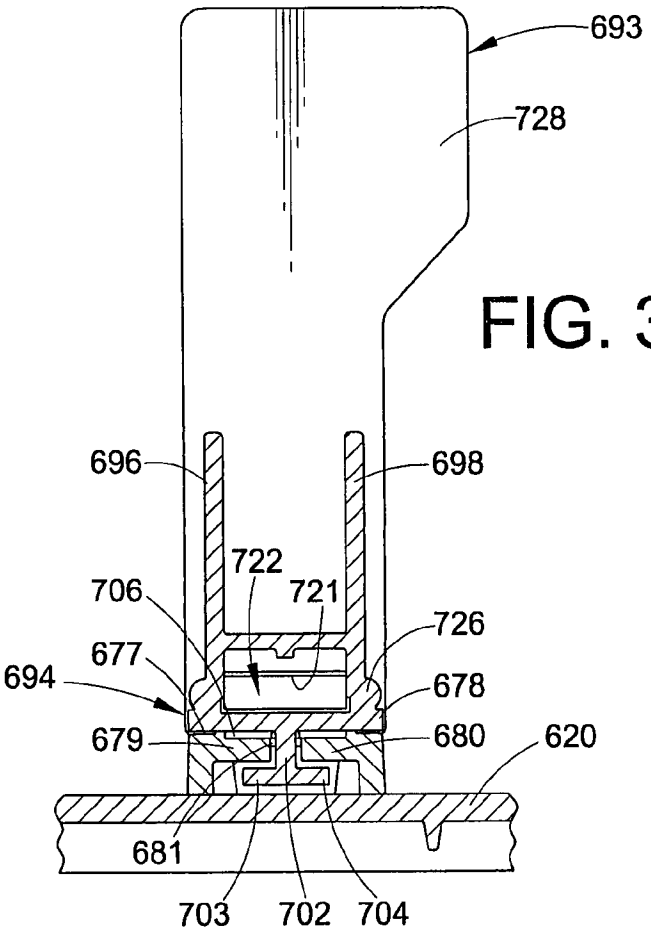
FIG. 38 is an enlarged rear view of the track, the paddle, and the mounting member of FIG. 28, partially in cross-section.

With reference now to FIGS. 34 and 35, a pusher member 692 is shown which can be slidably mounted on the track 676 in a reciprocating manner. The pusher member 692 includes a vertically extending pusher wall 693 and a base wall 694. Connecting the pusher wall 693 and the base wall 694 are first and second brace walls or gussets 696 and 698. As described above, the two brace walls 696 and 698 can be stiffened with stiffening ribs 726. Depending from the base wall 694 is a foot 700. In this embodiment, a first portion 702 of the foot extends normally from the base wall 694 and is positioned between the gussets 696 and 698. A second portion or flange 703 of the foot can be oriented approximately normal to the first portion 702 and can be parallel to a plane of the base wall 694. Similarly, a third portion or flange 704 of the foot can be oriented approximately normal to the first portion 702 and can be parallel to the plane of the base wall 694. Thus, a pair of somewhat U-shaped sections are formed for accommodating the guide sections 679 and 680 (refer to FIG. 38), whereby the first portion 702 is positioned in the central channel 681 and flanges 703 and 704 can slide underneath guide sections 679 and 680.

Figure 39:
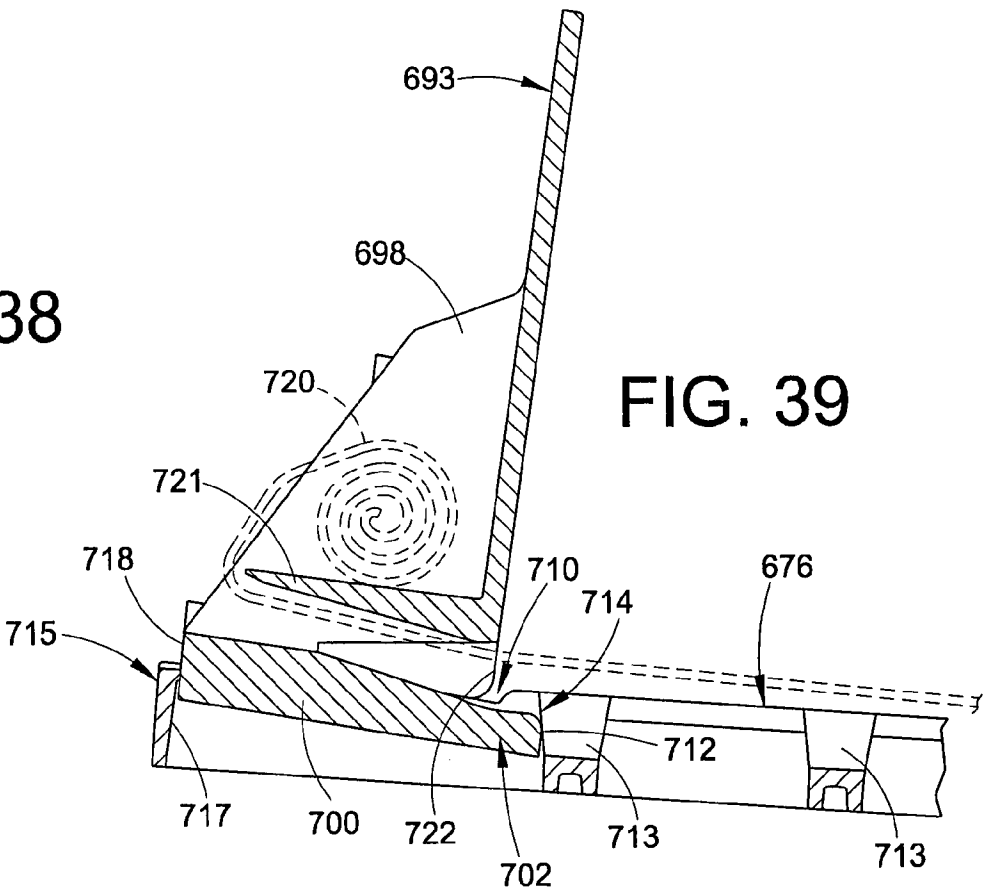
FIG. 39 is an enlarged side elevational view, in cross-section, of the track and the paddle of FIG. 28 with the paddle in the retracted and retained position.

It is to be appreciated that a coil spring 720 can be housed on the pusher member 692. More particularly, the coil spring 720 can be supported on a support wall 721 extending between the pair of brace walls 696 and 698. A front end of the coil spring 720 can be secured to a front portion of the shelf divider. A central section of the coil spring 720 extends away from the pusher 692 through a slot 722 defined in the pusher wall 693. With reference now also to FIG. 39, it can be seen that the coil spring is mounted on the support wall 721, curls around a back end thereof and then extends forwardly out through the slot 722. In use, as the pusher 692 reciprocates on the track 676 formed by the guide sections 679 and 680, the channel 681 and the rails 677 and 678, a lower surface 706 of the base wall 694 contacts and rides along the rails 677 and 678. Due to the cooperation of the foot 700 and the flanges 703 and 704 with the guide sections 679 and 680, the pusher 692 can not be lifted away from the track. Rather, the pusher 692 must be slid to an end of the track to be subsequently removed.

Figure 32:
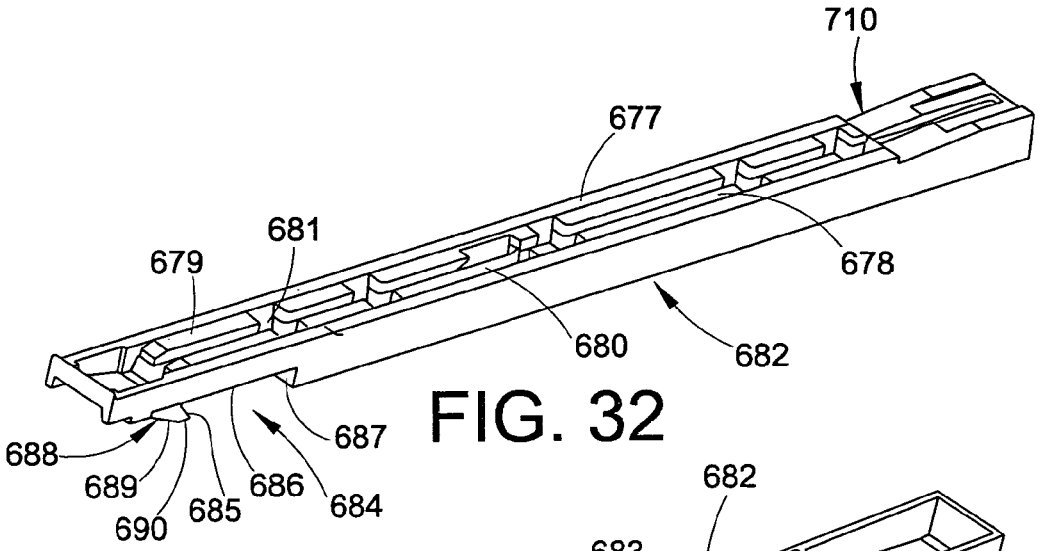
FIG. 32 is a top perspective view of a track of FIG. 28.
Figure 33:
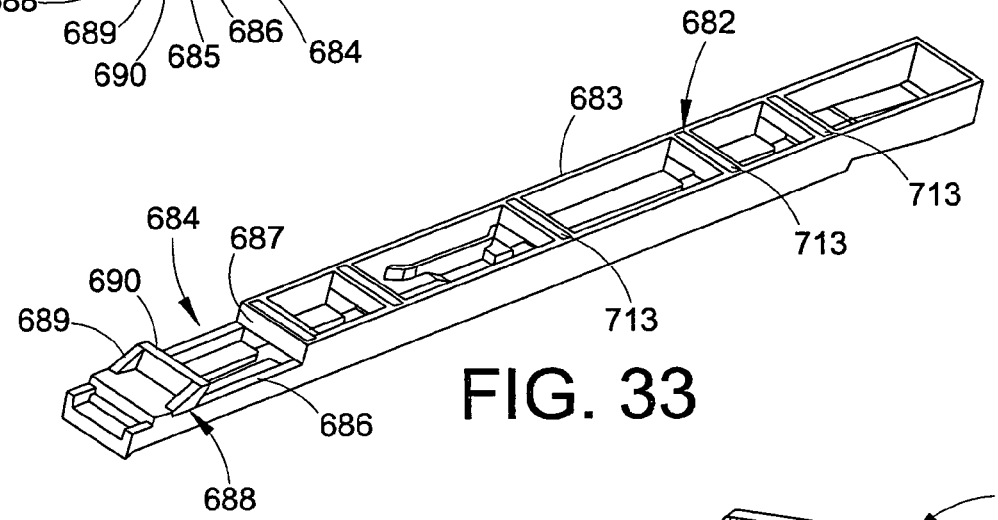
FIG. 33 is a bottom perspective view of the track of FIG. 32.

With reference now to FIGS. 32 and 39, track 676 includes a downward sloping section 710. It can be seen that when the pusher 692 is fully retracted, a front edge 712 of the foot 700 can be tilted downward along the sloping section 710. The front edge 712 engages a stop wall 714 located adjacent the forward end of the sloping section 710. The engagement of first portion 702 and stop wall 714 prevents movement of the pusher 692 along the track 676. In this manner, the pusher 692 can remain stationary to facilitate the stocking of sale items on the shelf system. To once again allow sliding of pusher 692, the pusher wall 693 is tilted backward to align the foot 700 with the track 676. The pusher 692 does not fall off the track as a rear edge 718 of the foot 700 contacts a depending section 715 of a rear wall 717 of the track 676. In order to connect the two rails 677 and 678, connecting ribs 713 can be employed, as is shown in FIGS. 33 and 39. It is a rearmost one of the connecting ribs which can serve as the stop wall 714. Moreover, the pusher wall 693 can have an enlarged upper end 728 in order to better accommodate wider merchandise that is being urged forwardly on the track 676 by the pusher member 692.

With reference again to FIG. 31, it can be seen that the angle of the front face 630 of the wall 620 in relation to a plane of the second groove 622 can be, for example, 52°. The angle between the shelf divider front face 662 in relation to a plane of the roof 665 in the slot 660 can be slightly less than 52° (ie. 51°). As a result, when the shelf divider 650 is seated on the mounting member 610, a pinching action takes place between the front face 662 of the slot 660 and the front face 630 of the horizontal wall 620. Such pinching action engages the shelf divider 650 to the mounting member 610 to retard a sideward sliding motion of the shelf divider 650 on the mounting member 610. Such pinching action is possible due to the resilient nature of the materials from which the shelf divider and the mounting member are made. If desired, these two components can be made of suitable conventional resilient materials, such as known thermoplastic materials. These will allow some relative flexing between the two as the shelf divider 650 is mounted on or detached from the mounting member 610. The two components can be made from the same material or from different materials. It should, of course, be appreciated that other suitable angles could be provided on the interengaging surfaces of the mounting member and the shelf divider to provide the desired pinching action or locking action. In this embodiment, the pinch point occurs at the engagement of the horizontal wall 620 front face 630 with the slot front face 662. However, it should be appreciated that such pinch points could be located at other positions along the engagement surfaces of the mounting member and shelf divider.

Of course, such sideward sliding movement is also retarded by the interengaging sets of teeth 636 and 668 on the mounting member 610 and the shelf divider 650 respectively. To this end, the back face 634 can be angled forwardly by 5° from the vertical. Similarly, the rear face 667 can be angled forwardly by 5° from the vertical. Thus, there is a mating engagement of the mounting member back face with the rear face 667 of the shelf divider 650.

As is best seen from FIG. 29, the locking action of the shelf divider 650 on the mounting member 610 takes place when the shelf divider is fully lowered onto the mounting member. However, when a rear end of the shelf divider is slightly lifted, the shelf divider is rotated in relation to the mounting member. This action unlocks the shelf divider from the mounting member, disengages the two sets of teeth 636 and 670 and allows the shelf divider to be moved along the mounting member 610 to a desired location. To this end, the shelf divider can either be slid along the mounting member 610 or simply pulled away from the mounting member 610 and laterally moved to the desired location and then reconnected with the mounting member 610.

With reference again to FIG. 30, the angle between a track front face 685 in relation to a plane of the slot roof 686 located in the track 676 can be slightly less than 52° (ie. 51°). As a result, when the track 676 is completely seated on the mounting member 610 a pinching action takes place between the front face 685 and roof 686 of the track 676 and the front face 630 and top face 632 of the horizontal wall 620. Such pinching action retains the track 676 onto the mounting member 610 to retard a sideward sliding motion of the track 676 on the mounting member, as previously discussed in connection with other embodiments of the present invention.

As is best seen from FIGS. 29 and 30, the pinching action of the track 676 on the horizontal wall 620 only takes place when the track 676 is fully lowered onto the mounting member 610. However, when a rear end of the track is slightly lifted, the track is rotated in relation to the mounting member. This action releases the track 676 from the mounting member and allows the track 676 to be moved sideways in relation to the mounting member to a desired location. To this end, the track 676 can either be slid along the mounting member or simply pulled away from the mounting member and laterally moved to the desired location and then reconnected with the mounting member.

Figure 41:
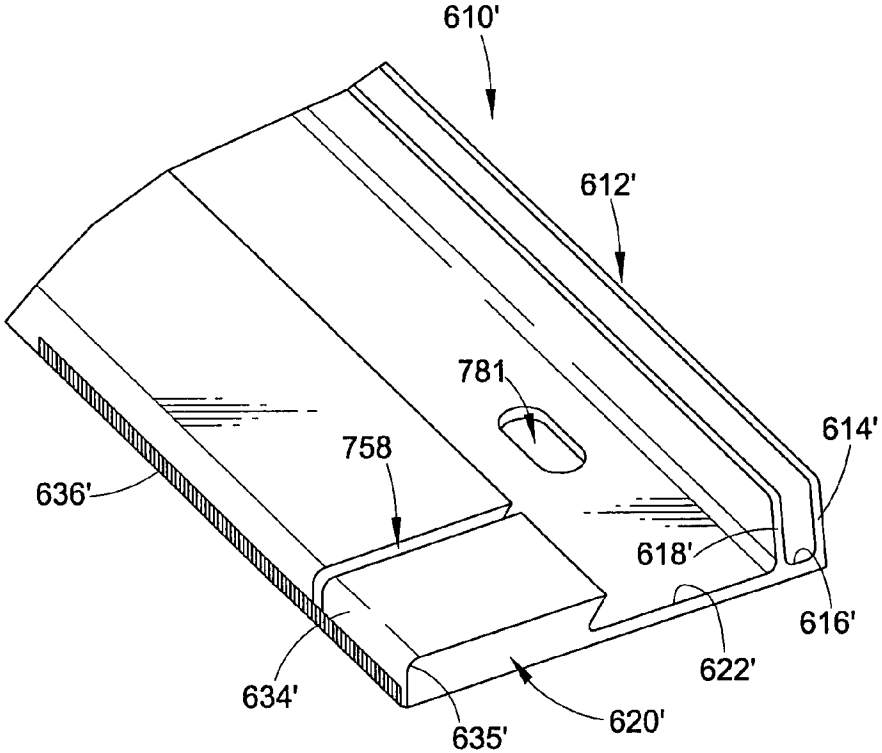
FIG. 41 is a perspective view of a mounting member according to a sixteenth embodiment of the present invention.
Figure 40:
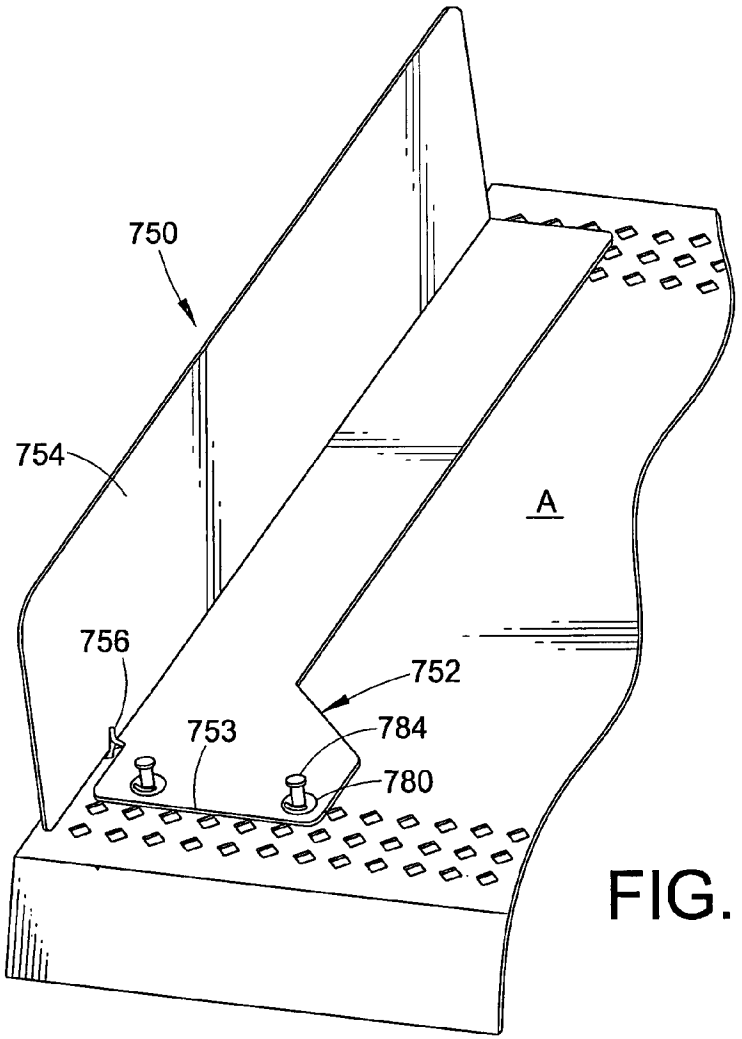
FIG. 40 is a perspective view of a left end shelf divider mounted to an associated shelf according to a fifteenth embodiment of the present invention.

With reference now to FIG. 40, an end wall 750, which can be used with the shelf divider system of FIGS. 28-39, includes a base 752 and an upright portion 754. A transversely extending slot 756 is located adjacent a forward end of the end wall 750. The end wall illustrated is used on the left end of the shelf A. With reference now to FIG. 41, another embodiment of a mounting member is there illustrated. In this embodiment, like components are identified by like numerals with a primed (') suffix and new components are identified by new numerals. The slot 756 is adapted to accommodate a groove 758 through a horizontal wall 620' in a mounting member 610'. Provided on the base 752, proximal to a front edge 753, are a plurality of apertures 780. Mounting member 610' can also include a slot 781. The apertures 780 and slot 781 are meant to accommodate suitable conventional fasteners 784 in order to secure the end wall 750 and mounting member 610', respectively, in place on the associated shelf.

Figure 42:
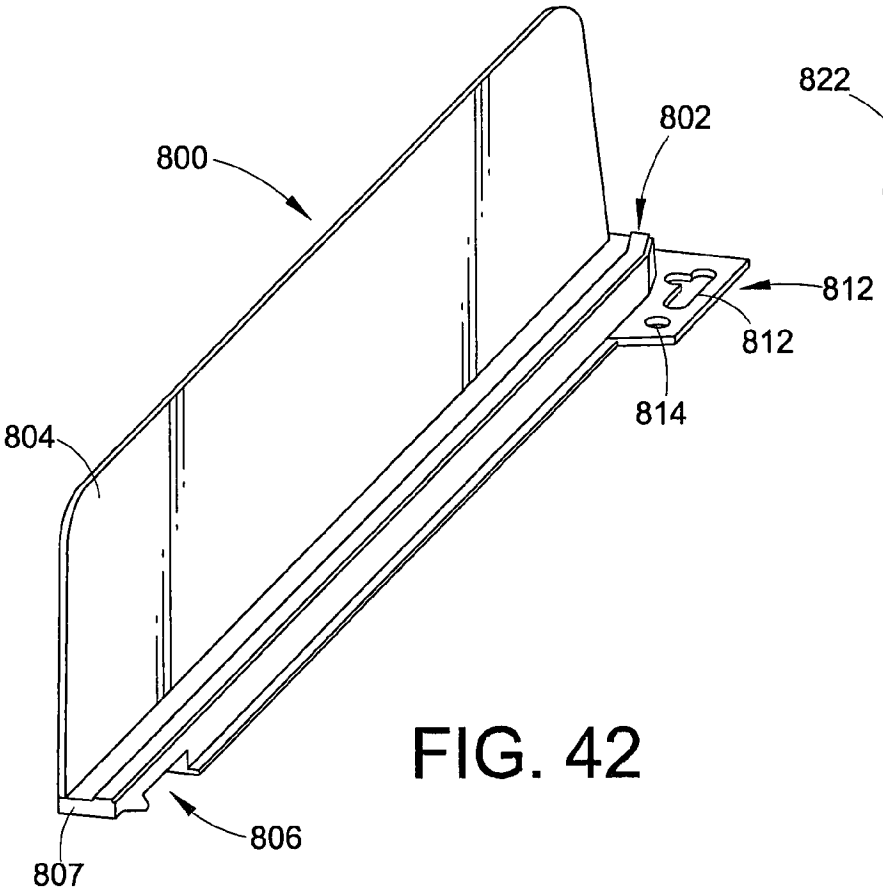
FIG. 42 is a perspective view of a left end shelf divider according to a seventeenth embodiment of the present invention.

With reference now to FIG. 42, an end wall 800 according to yet another embodiment of the invention for the shelf divider system includes a base 802 and an upright portion 804. A transversely extending slot 806 is located adjacent a first end of the end wall 800. Similar to the description above, the slot is defined by a flange at a front end, and a back wall with teeth at a rear end. The slot 806 is adapted to accommodate, and engage with, the horizontal walls 620 and 620' of mounting members 610 and 610'. A front edge 807 of the divider can be positioned in the second groove 622 and 622'. Cooperating with the end wall 800 is a flange 810. Provided on the flange 810 is a slot 812 and an aperture 814. These are meant to accommodate suitable conventional fasteners (not shown) in order to secure the end wall 800 in place on the associated shelf. In contrast to the embodiment of FIG. 40 wherein a front section of the end wall is secured to the shelf, in the embodiment of FIG. 42, a rear section of the end wall is fastened to the subjacent shelf. As shown in FIG. 42, the base 802 extends to the right of the upright portion 804, thus providing a left end wall, but it is to be appreciated that the base 802 could be reconfigured to extend to the left of the upright portion (not illustrated) to provide a right end wall.

Figure 43:
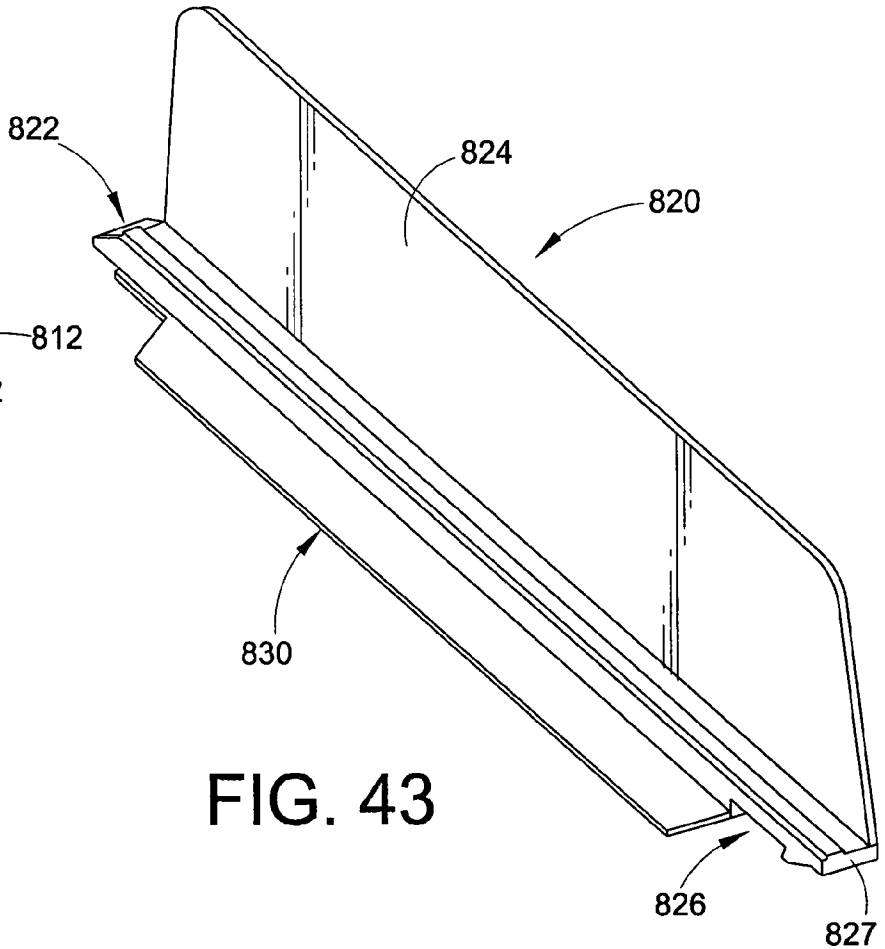
FIG. 43 is a perspective view of a right end shelf divider according to an eighteenth embodiment of the present invention.

With reference now to FIG. 43, an end wall 820 according to another embodiment of the invention for the shelf divider system includes a base 822 and an upright portion 824. A transversely extending slot 826 is located adjacent a first end of the end wall 820. Similar to the description above, the slot is defined by a flange at a front end, and a back wall with teeth at a rear end. The slot 826 is adapted to accommodate, and engage with, the horizontal walls 620 and 620' of the mounting members 610 and 610'. A front edge 827 of the divider can be positioned in the second groove 622 and 622'. Cooperating with the base 822 of the end wall 820 is a longitudinally extending flange 830. The flange 830 assists in maintaining alignment and spacing of a separate track 676 between a divider and the end wall 820. As shown in FIG. 43, the base 822 extends to the left of the upright portion 824 thus providing a right end wall, but it is to be appreciated that the base 822 could be reconfigured to extend to the right of the upright portion (not illustrated) to provide a left end wall.

Figure 44:
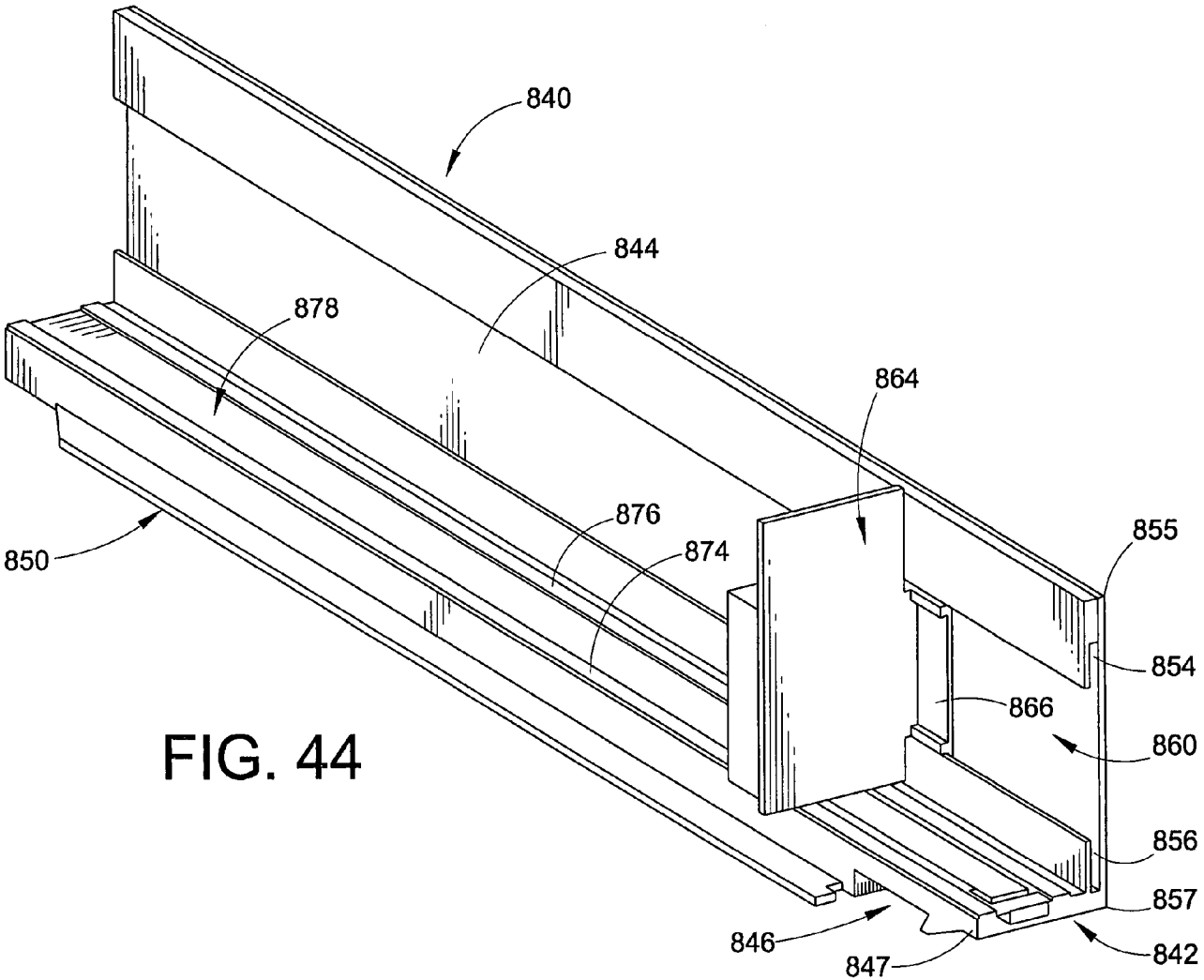
FIG. 44 is a front perspective view of a right end shelf divider including a pusher or paddle mounted on a divider wall according to a nineteenth embodiment of the present invention; and, FIG. 45 is a rear perspective view of the shelf divider and pusher of FIG. 44 showing a spring for biasing the pusher.
Figure 45:
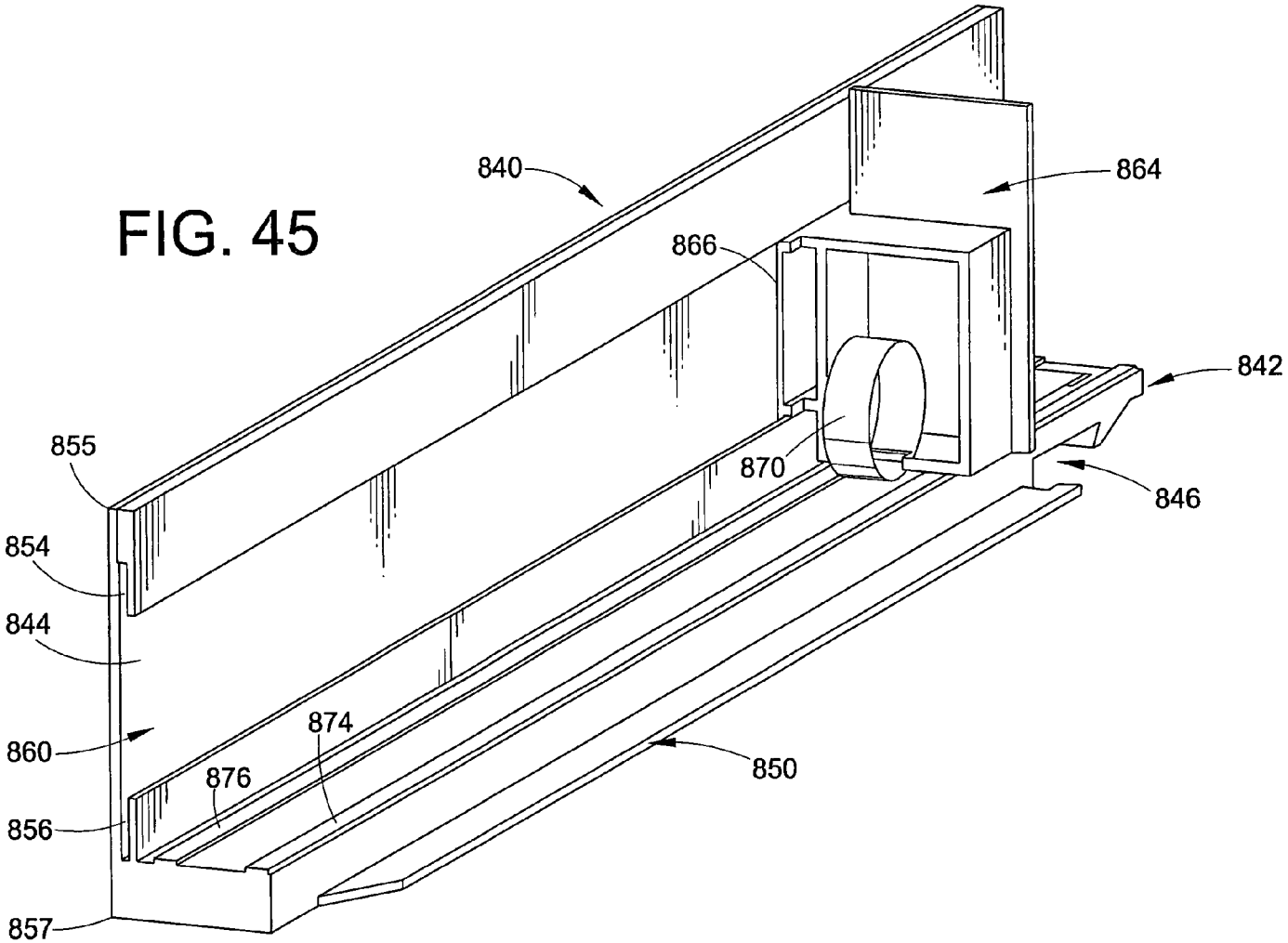

With reference now to FIGS. 44 and 45, a different type of right end wall 840 according to yet another embodiment of the invention is there illustrated. This version of the end wall includes a base 842 and an upright portion 844. A transversely extending slot 846 is located adjacent a first end of the end wall 840. Similar to the description above, the slot is defined by a flange at a front end, and a back wall with teeth at a rear end. The slot 846 is adapted to accommodate, and engage with, the horizontal walls 620 and 620' of the mounting member 610 and 610'. A front edge 847 of the divider can be positioned in the second groove 622 and 622'. Cooperating with the base 842 of the end wall 840 is a longitudinally extending flange 850. The flange 850 assists in maintaining alignment and spacing of a separate track between a divider and the end wall 840. The upright portion 844 includes a pair of longitudinally extending slots 854 and 856. Slot 854 is adjacent an upper edge 855 of the upright portion 844. Slot 856 is adjacent a lower edge 857 of the upright portion 844. The slots 854 and 856 define a track 860 therebetween. Thus, a vertically oriented track is disclosed. End wall 840 includes a side mounted pusher 864. The pusher includes an arm 866. The ends of the arm 866 are slidingly retained in slots 854 and 856 and reciprocate along passage 860 wherein the pusher 864 is mounted to a side of the upright wall 844. The pusher 864 can be spring biased by, for example, a coil spring 870 (refer to FIG. 45). In use, merchandise is supported, at least partially, on a pair of longitudinally extending rails 874 and 876 along an upper surface 878 of the base 842. The merchandise can be moved toward the front of the shelf by the spring biased pusher 864 along rails 874 and 876.

In the embodiments discussed hereinbefore, either a front mounting member/rail or a rear mounting member/rail was employed. However, it should be recognized that both a front rail and a rear rail can be utilized as mounting members for mounting a combination shelf divider and pusher track or separate shelf dividers and pusher tracks. The use of two rail designs in general is known in the art. Therefore, it can be appreciated that two rails or mounting members can be employed in the adjustable shelving system of the present invention.

In the various embodiments disclosed herein, the contact surface located on the divider member or track or member which cooperates with the mounting member or front rail is disclosed as being located in the slot. However, it should be appreciated that the contact surface, which can be a set of teeth, can also be located near the slot, adjoining the slot, in proximity to the slot, in the vicinity of the slot and the like. Thus, the second contact surface does not necessarily have to lie within the slot or be contiguous with or abutting, touching or in juxtaposition with the slot. Rather, it can be in the neighborhood of the slot. The location of the second contact surface, which can be a second set of teeth, is determined by the location of the first contact surface, which can be a first set of teeth, on the mounting member or track. All that is necessary is that the two engage each other and cooperate with each other in order to retard a sideward sliding motion of the divider track or cooperating member in relation to the elongated mounting member or rail.

While the embodiments disclosed herein illustrate the use of a slot, i.e., a transverse groove or opening, it should be appreciated that other types of openings could be provided along the bottom face of the cooperating member, track or divider assembly disclosed herein. Thus, any type of suitable aperture, way, path, channel, passage or other suitable gap could be employed. For example, a set of notches could be provided along the bottom face instead of a single slot if the mounting member or rail were suitably configured. Thus, the term "slot" as used herein is intended to include all such openings, apertures, holes, orifices, passages, grooves, troughs, channels, indentations and the like.

The invention has been described with reference to preferred embodiments. Obviously, modifications and alterations will occur to others upon the reading and understanding of this specification. It is intended to include all such modifications and alterations insofar as they come within the scope of the appended claims or the equivalents thereof.

Having thus described the preferred embodiments, the invention is claimed as follows:

1. A shelving system comprising:

an elongated mounting member operationally securable to an associated shelf, said mounting member comprising:

an approximately vertically oriented wall including first and second sections separated by a first vertically oriented groove, an approximately horizontally oriented wall including a planar top face having a width which is greater than a width between outer faces of said first and second sections of said approximately vertically oriented wall and at least one first tooth disposed rearward of said top face, and, a second vertically oriented groove separating the approximately vertically oriented wall from the approximately horizontally oriented wall, wherein said planar top face is elevated above said second vertically oriented groove;

a track received on said mounting member, wherein said track extends approximately transversely to a longitudinal axis of the associated shelf, said track comprising:

an elongated rail extending longitudinally along said track, and a pusher slidably mounted in relation to said rail;

a divider received on said mounting member, wherein said divider extends approximately transversely to said longitudinal axis of the associated shelf; and, wherein said track and said mounting member engage each other rearward of a front face of said track along a pair of cooperating surfaces oriented at respective acute angles in relation to a vertical axis and said track does not engage said at least one first tooth of said mounting member, said divider being spaced from said track.

2. The shelving system of claim 1 wherein said track further comprises a front edge, and a groove located rearwardly of said front edge.

3. The shelving system of claim 2 wherein said track front edge is located at said mounting member second groove.

4. The shelving system of claim 3 wherein said divider comprises a second tooth, said at least one first tooth engaging said second tooth to retard a sliding motion of said divider on said mounting member.

5. The shelving system of claim 1 wherein said pusher comprises a foot extending from a base member, said foot cooperating with said rail.

6. The shelving system of claim 5 wherein said pusher further comprises a front wall extending upwardly from said base member.

7. The shelving system of claim 1 further comprising a spring having one end mounted to said track and another end located on said pusher for biasing said pusher forwardly on said track.

8. The shelving system of claim 1 wherein at least one of said mounting member and said track comprises a resilient material to allow a relative flexing between said mounting member and said track.

9. The shelving system of claim 1 further comprising a fence selectively mounted in said first groove.

10. A shelving system comprising:

an elongated mounting member operationally securable to a front portion of an associated shelf, said mounting member comprising:

an approximately vertically oriented first wall, an approximately horizontally oriented second wall including a planar top face, and;

a groove disposed between said first and second walls wherein said second wall planar top face and said groove are of generally equal width and wherein said second wall planar top face is elevated in relation to said groove, a track received on said mounting member in a sliding manner such that a forward portion of said track is spaced from and is out of contact with said elongated mounting member first wall, wherein said track and said mounting member engage each other at said second wall and, wherein said track extends rearwardly over the associated shelf;

an elongated rail extending longitudinally along said track;

a spring urged pusher slidably mounted in relation to said rail;

a divider received on said mounting member, wherein said divider extends rearwardly over the associated shelf, said divider being spaced from said track.

11. The shelving system of claim 10 wherein said divider further comprises a bottom face, a front edge and a slot located in said bottom face, wherein said slot is located rearwardly of said front edge.

12. The shelving system of claim 11 wherein said mounting member comprises a first longitudinally extending groove, said divider front edge being accommodated in said mounting member first groove.

13. The shelving system of claim 12 wherein said track comprises a front edge and a transverse slot located rearwardly of said front edge, said track front edge being accommodated in said mounting member first groove.

14. The shelving system of claim 10 wherein said pusher comprises a foot extending from a base of said pusher, said foot cooperating with said rail.

15. The shelving system of claim 14 wherein said pusher further comprises a front wall extending upwardly from said base.

16. The shelving system of claim 10 wherein at least one of said track and said mounting member comprises a resilient material to allow a relative flexing between said first mounting member and said track.

17. The shelving system of claim 10 wherein said spring urged pusher comprises a coil spring having a first end mounted to one of said track and said first mounting member and a second end located on said pusher.

18. The shelving system of claim 10 further comprising a first set of teeth extending from a face of said mounting member.

19. The shelving system of claim 18 further comprising at least one second tooth extending from said divider, said at least one second tooth engaging said first set of teeth to retard a sideward sliding motion of said divider in relation to said mounting member.

20. The merchandising system of claim 10 wherein said divider comprises a base portion and a vertically oriented wall portion extending from said base portion and dividing said base portion into a first section and a second section.

21. The merchandising system of claim 20 wherein said divider base portion includes a transversely extending slot.

22. A merchandising system comprising:

an elongated mounting member operationally securable to a front portion of an associated shelf and extending parallel to a longitudinal axis thereof, said mounting member comprising:

an approximately vertically oriented wall including first and second sections, an approximately horizontally oriented wall including a raised area comprising a front face, a planar top face which is of larger dimension than said front face, a back face and a plurality of teeth located on said back face;

a first track received on said mounting member in a sliding manner, wherein said first track extends rearwardly over the associated shelf, said track including a pusher slidably mounted thereon, said pusher being biased in a forward direction;

wherein said mounting member comprises a first longitudinally extending groove separating said raised area of said approximately horizontally oriented wall from said approximately vertically oriented wall, and wherein said first track includes a front portion that is accommodated in said mounting member first groove such that a front surface is spaced away from any portion of said first and second sections of said approximately vertically oriented wall; and a first divider received on said mounting member in a non-sliding manner via a positive engagement;

wherein said first track comprises a front face and a bottom face in which is defined a transversely extending slot, wherein said first track slot includes a pair of walls which engage said front face and top face of said mounting member raised area to provide the positive engagement at a location rearwardly of said first track front face and said first track does not engage any of said plurality of teeth of said mounting member to provide a sliding engagement.

23. The shelving system of claim 22 wherein said first divider includes a front portion that is accommodated in said mounting member first groove.

24. The merchandising system of claim 22 further comprising:

at least one tooth located on said divider, said at least one divider tooth engaging said at least one of said plurality of teeth of said mounting member to retard a sideward sliding motion of said divider in relation to said mounting member.

25. The shelving system of claim 24 wherein said at least one tooth located on said divider is located in a slot defined in said divider.

26. The merchandising system of claim 24 further comprising:

a plurality of additional tracks mounted on said elongated mounting member, said plurality of additional tracks being spaced from each other and from said first track; and a plurality of additional dividers mounted on said elongated mounting member, said plurality of additional dividers being spaced from each other and from said first divider.

27. The shelving system of claim 26 wherein each two of said plurality of dividers is separated by at least one of said plurality of tracks.

28. The shelving system of claim 26 wherein said plurality of tracks each further include:

an elongated rail extending longitudinally along said track, said pusher being mounted on said rail; and, a spring which provides the bias for biasing said pusher forwardly on said rail.

29. The shelving system of claim 28 wherein said plurality of tracks each include a foot extending from said pusher member, said foot cooperating with said rail.

30. The shelving system of claim 29 wherein each said divider further comprises a slot located rearwardly of said front portion.

31. The merchandising system of claim 22 wherein said divider comprises a base portion and a vertically oriented wall portion extending from said base portion and dividing said base portion into a first section and a second section.

32. The merchandising system of claim 31 wherein said divider base portion includes a transversely extending slot.

33. The shelving system of claim 32 wherein said at least one tooth is located in a slot defined in said divider.

* * * * *